US005311232A

United States Patent [19]

Dech et al.

[11] Patent Number: 5,311,232

[45] Date of Patent: May 10, 1994

[54] FILM MAGAZINE FOR FEEDING FILM DEVELOPING MACHINES AND DEVICE FOR PREPARING SAID MAGAZINE

[75] Inventors: Rudolf Dech, Oberweningen, Switzerland; William Da Ros, Pordenone, Italy

[73] Assignee: Gretag San Marco S.r.l., Pordenone, Italy

[21] Appl. No.: 635,704

[22] Filed: Dec. 28, 1990

[30] Foreign Application Priority Data

Dec. 28, 1989 [IT] Italy ..... 45803 A/89

[51] Int. Cl.[5] ..... G03D 13/00

[52] U.S. Cl. ..... 354/298

[58] Field of Search ..... 354/312, 298, 313, 319-327, 354/297, 310, 308, 311, 314

[56] References Cited

U.S. PATENT DOCUMENTS 3,568,587 3/1971 Laval ..... 354/297 X
4,860,044 8/1989 Kanai et al. ..... 354/321

FOREIGN PATENT DOCUMENTS 0157214 10/1985 European Pat. Off. .
0242817 10/1987 European Pat. Off. .

OTHER PUBLICATIONS

Patent Abstracts of Japan, vol. 12, No. 175, May 25, 1988.

Patent Abstracts of Japan, vol. 11, No. 216, Jul. 14, 1987.

*Primary Examiner*—D. Rutledge
*Attorney, Agent, or Firm*—Wenderoth, Lind & Ponack

[57] ABSTRACT

Device per preparing in advance magazines (21) for films to be introduced in a film developing machine, comprising a flat table (32) provided on the upper part of the preparation station (27) of the machine, which is shaped with a set of seats adapted to house the materials and the tools provided to join the films to be developed, which are either contained in their rolls in the case of films of size 135 or introduced in a suitable container (67) in the case of films of different sizes, with the associated leader (63).

Such joining, in particular, is carried out directly on the magazine (21) which rests on a suitable seat of the flat table (32).

Each so prepared magazine is inserted in the loading station (23) of the film developing machine, where the file is fully unrolled therefrom and, in the case of film of size 135, also cut at its terminal end.

The particular shape of the magazine (21) and of the loading station (23) of the film developing machine are described, which permit the treatment of film of each size by avoiding any possible slipping of the films out of the associated magazine (21).

18 Claims, 15 Drawing Sheets

Fig.10
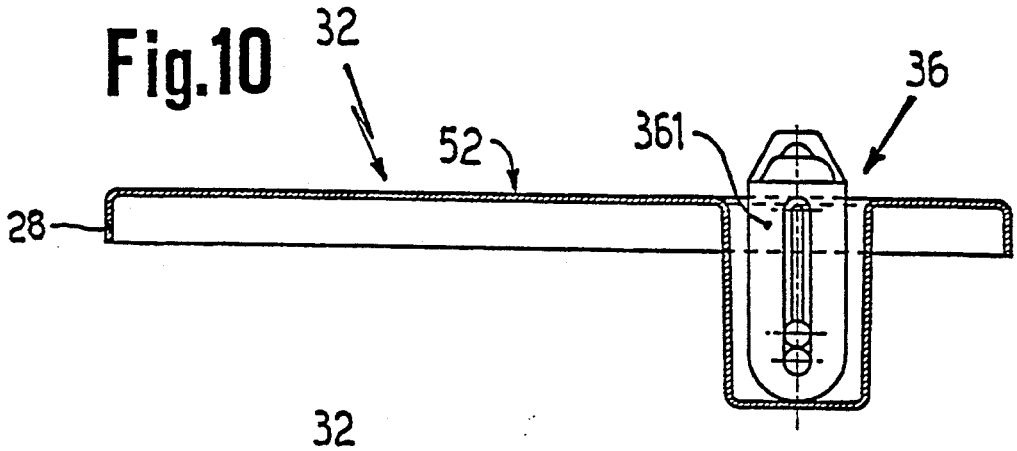
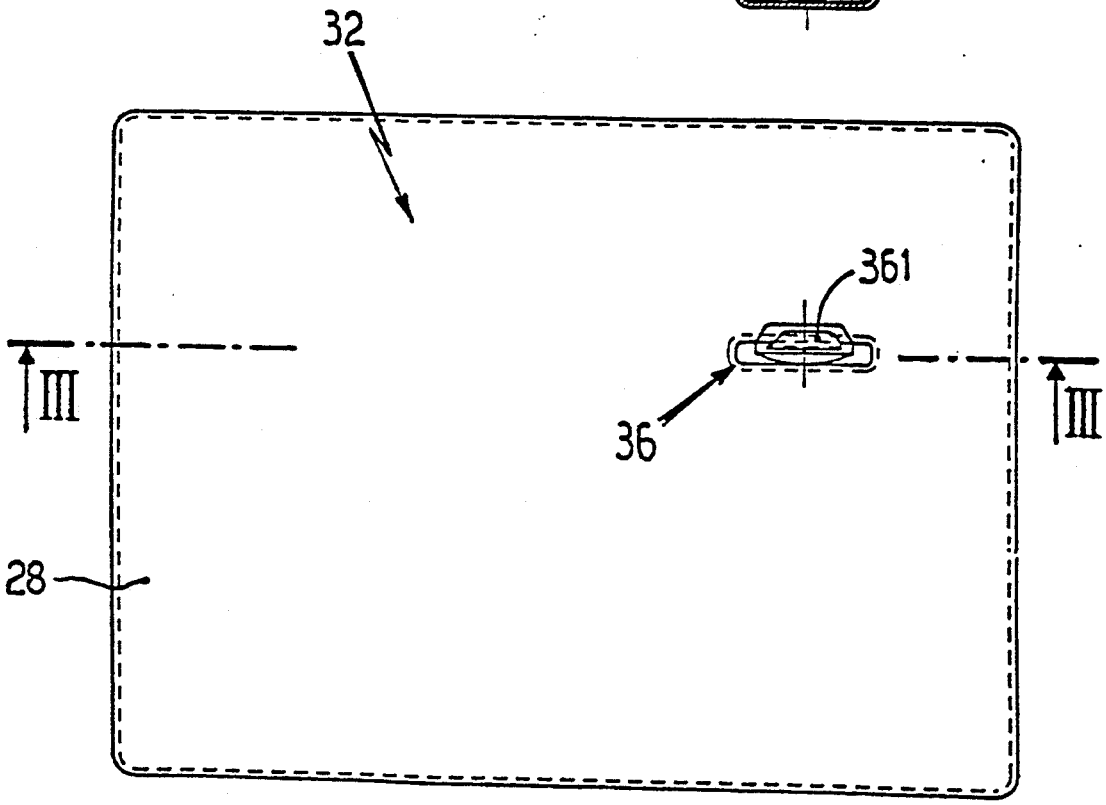
Fig.5

Fig.12
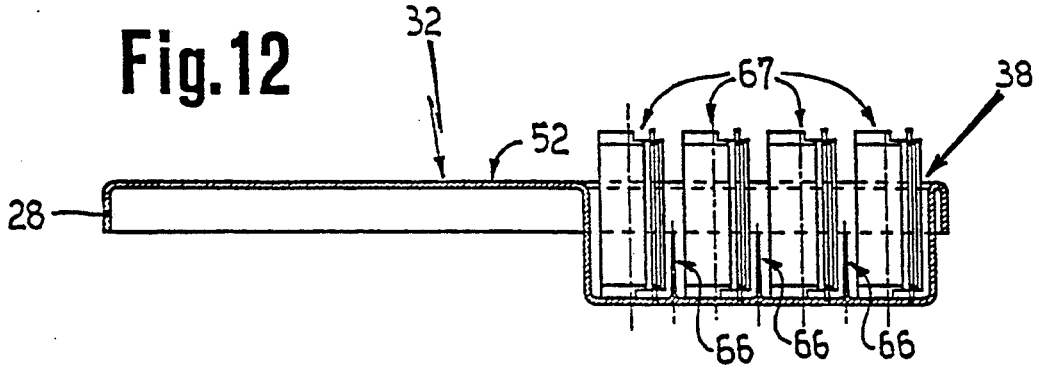
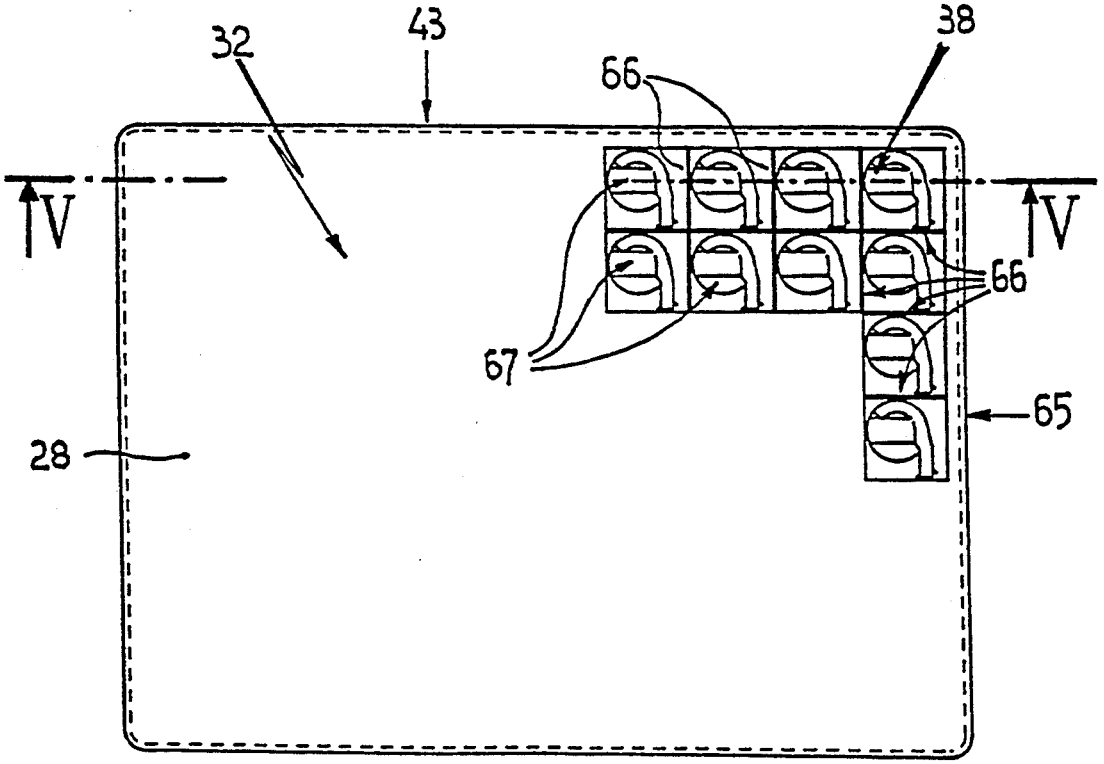
Fig.7

FILM MAGAZINE FOR FEEDING FILM DEVELOPING MACHINES AND DEVICE FOR PREPARING SAID MAGAZINE

BACKGROUND OF THE INVENTION

The present invention relates to a simple and practical device for preparing film magazines for film developing machines, as well as to a new film magazine adapted to contain films of different sizes and to permit the automatic developing thereof in a film developing machine.

Developing machines for differently sized films are known, and substantially comprise a closed casing into which the films to be developed are introduced from a loading station. The films are hooked or connected in a suitable way to a feeding mechanism which transports such films through a series of tanks containing different chemical treatment baths of conventional types in which the films are progressively treated and developed. Then the films arrive at a subsequent drying station where the developed films are thoroughly dried with conventional means and, finally, the films arrive at a storage station external to the machine where they can be picked up.

In particular, the films which are exposed and are wound around their respective reels are introduced to a preparation station normally adjacent to the loading station. The preparation station is a light-proof station and is provided with flexible tubes for receiving the operator's hands during the handling of such films. From here the films are transferred into a suitable container and thereafter they are connected at their one end to a correspondent "leader" constituted by a sheet of plastic material. Tape is used to join the film and leader on both surfaces of the same. Finally, a self-adhesive label for identifying the film is normally applied on the end of the film. Afterwards, the so prepared film is disposed in a feeding mechanism of the loading station and is engaged by such mechanism so that each leader and the film connected thereto are entrained by the feeding mechanism so as to be moved through the different treatment tanks and the drying and storage stations of the machine.

Instead of the above-mentioned joining method, other film developing machines of conventional kind use a specific type of magazine adapted to contain films of different sizes. These magazines are introduced to the loading station of the machines whereby the films are automatically entrained by the feeding mechanism.

In particular, in the prior art machines the films are loaded in the magazine by always handling the film within the preparation station in the above-mentioned conventional manner.

However, the manner in which the films to be developed must be inserted into the developing machine is inconvenient.

In the machines which do not employ a magazine, the different operations of preparing the films and introducing the films to the feeding mechanism of the loading station of the machines must be carried out with precision in order for the films to be perfectly aligned with the feeding mechanism and thus effectively entrained.

In practice, undesirable inconveniences may occur which may be irreparable. For instance, a casual and unintentional extraction of the film from its respective container may occur, particularly during the transferring thereof from the preparation station to the loading station. In addition, the machines which employ the magazines are limited to handling and developing only films with a pre-established size (at present, exclusively to size 135). Thus, it is impossible to develop films of different sizes in the same conventional machine of this type.

SUMMARY OF THE INVENTION

An object of the present invention is to overcome the above-described drawbacks in the film developing machines employing film magazines in the prior art. To achieve this object the present invention provides apparatus which facilitates a practical and complete preparation of films having different sizes, as well as a safe introduction of the same into the same developing machine. Specifically a preparation station and novel film magazine allow different sized films to be prepared for development within the same type of magazine which can be inserted into the developing machine via a loading station of the machine.

BRIEF DESCRIPTION OF THE DRAWINGS

The device referred to will be hereinafter described, in a preferred embodiment thereof, solely by way of a non-limitative example thereof, with reference to the accompanying drawings wherein:

FIGS. 3, 4, 5, 6 and 7 are enlarged plan views of respective parts of the device of FIG. 2;

FIGS. 8, 9, 10, 11 and 12 are sectional views of the respective parts shown in FIGS. 3, 4, 5, 6 and 7, as taken along the respective section lines I—I, II—II, III—III, IV—IV, V—V indicated in such figures;

DETAILED DESCRIPTION OF THE PREFERRED EMBODIMENTS

Figure 1:
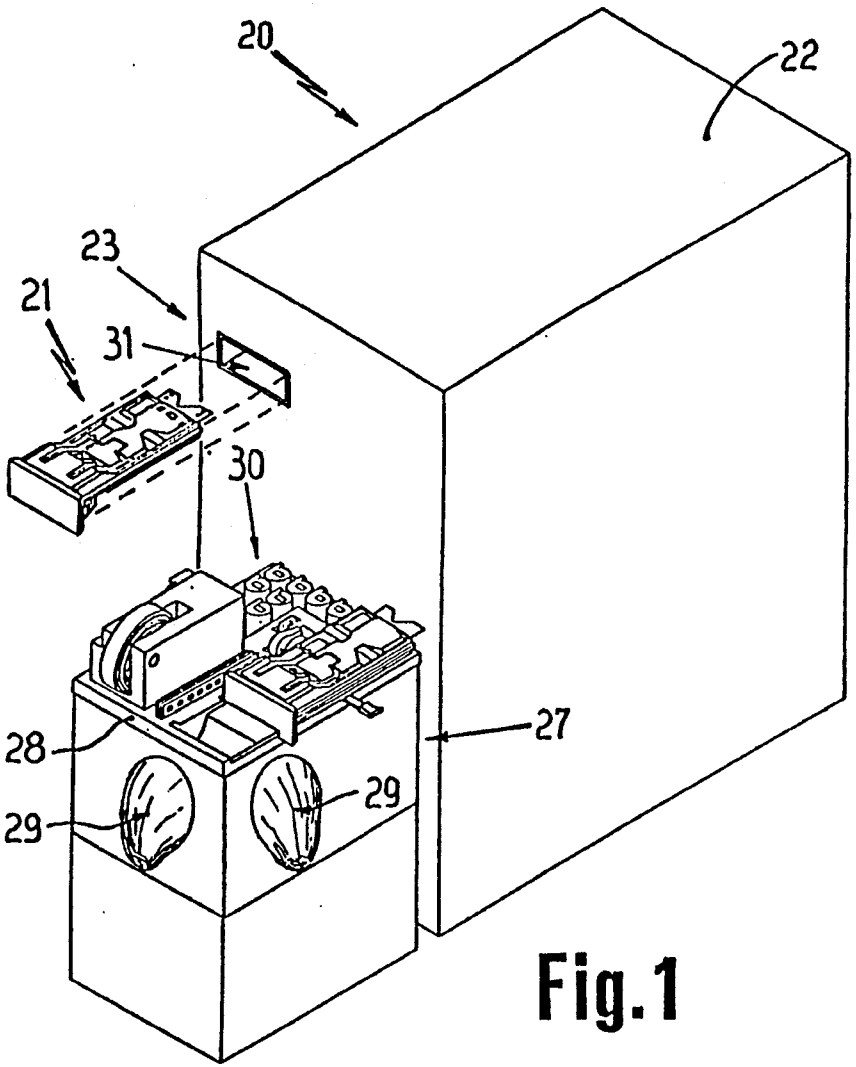
FIG. 1 is a schematic view in perspective of a film developing machine and of the device for preparing film magazines according to the invention.

FIG. 1 schematically illustrates a film developing machine 20 adapted to develop any size of film, between size 110 and size 620, by utilizing a film magazine 21 which will be described hereinafter.

This developing machine, of a per se known kind, substantially comprises a box-like casing 22 defining a station 23 for loading at least a film magazine 21 therein, a film treating station constituted by a series of tanks (not shown) containing the different chemical baths for treating the films, a station for drying the developed film, and a station for collecting the developed and dried film.

A lightproof preparation station 27 is provided at its upper part with a movable access door 28 and flexible tubes 29 for receiving the operator's hands therein. A device 30 for preparing film magazines 21 is disposed at the upper horizontal surface of the station 27.

The loading station 23 is in the form of an opening 31 adequately dimensioned for receiving the magazines 21 together with the films to be developed therein. When the magazine 21 is fully introduced into the opening 31, the leader 63 connected to the associated film is disposed at the level of a conventional machine feeding mechanism (not shown), and is engaged with the latter so that the film is transported through all of the tanks containing the chemical baths of the treatment station, as well as through the drying station, finally arriving at the collecting station, normally arranged outside the machine, where the developed and dried films are collected and may be picked up.

In turn, the device 30 for preparing film magazines (see FIG. 2) substantially consists of a flat table 32 in the shape of a parallelepiped and which forms the movable access door 28 of the preparation station. The table 32 is provided at its upper surface with a plurality of shaped seats 33, 34, 35, 36, 37 and 38, adapted to accommodate a magazine 21 for the film to be developed and all of the required tools and materials for preparing the film before the magazine is introduced into the opening 31 of the loading station 23 of the developing machine.

In particular, seat 33 accommodates the magazine 21. The seat 33 has a substantially rectangular shape and extends preferably parallel and adjacent to the front edge 40 of the flat table 32, and practically over almost the entire length of the same table.

Figure 15:
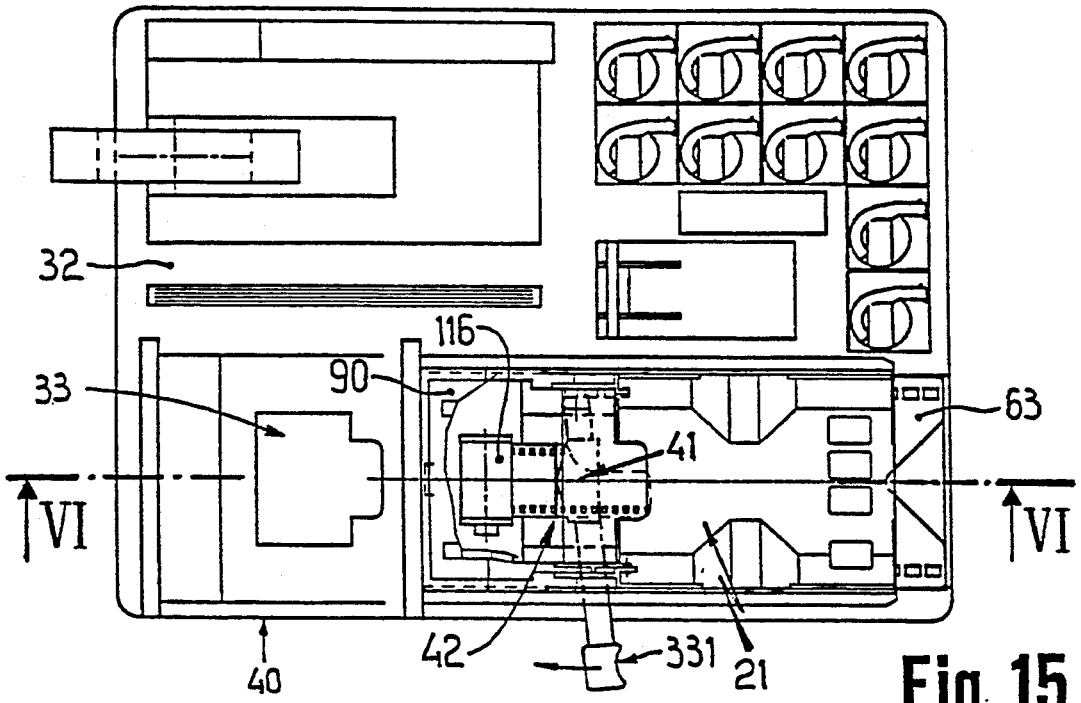
FIGS. 15 and 16 are schematic plan views of the magazine of FIG. 13 fitted to the device of FIG. 2 in two different film preparing positions, respectively.
Figure 16:
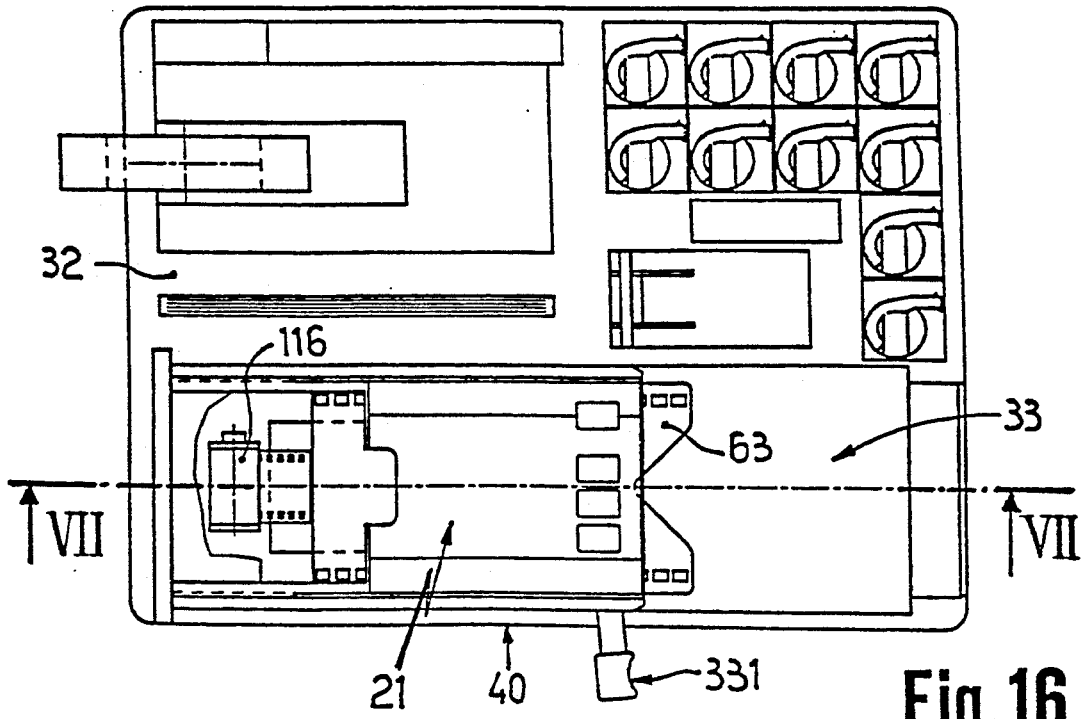
Figure 17:
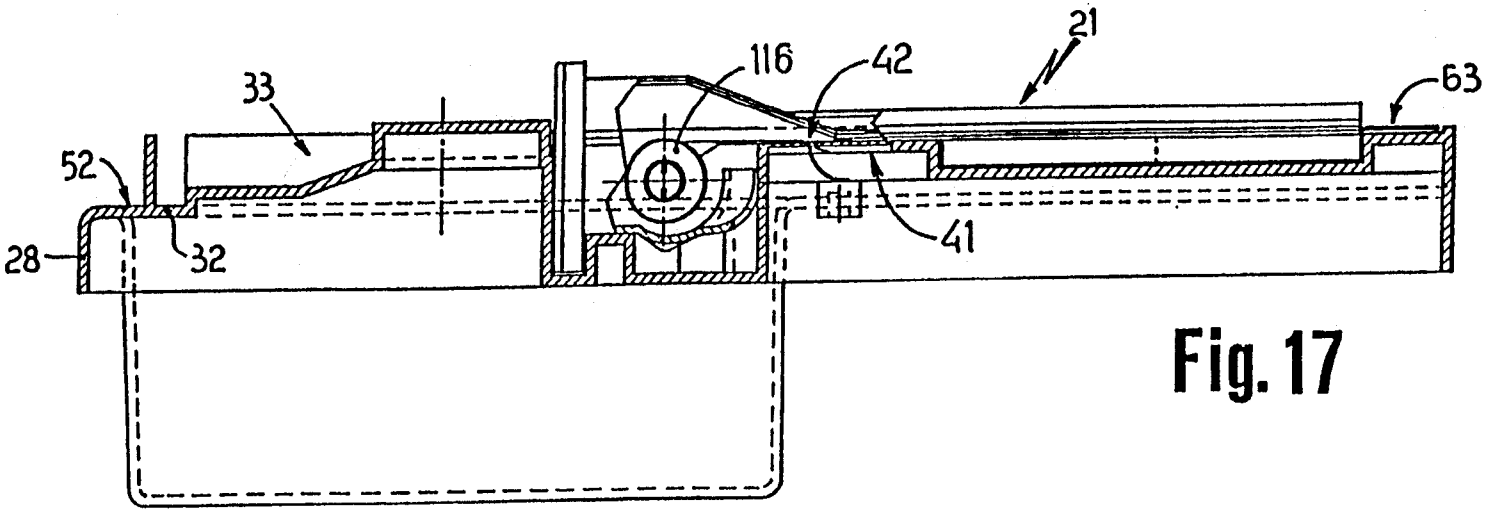
FIGS. 17 and 18 are sectional views taken, respectively, along line VI—VI of FIG. 15 and VII—VII of FIG. 16.
Figure 18:
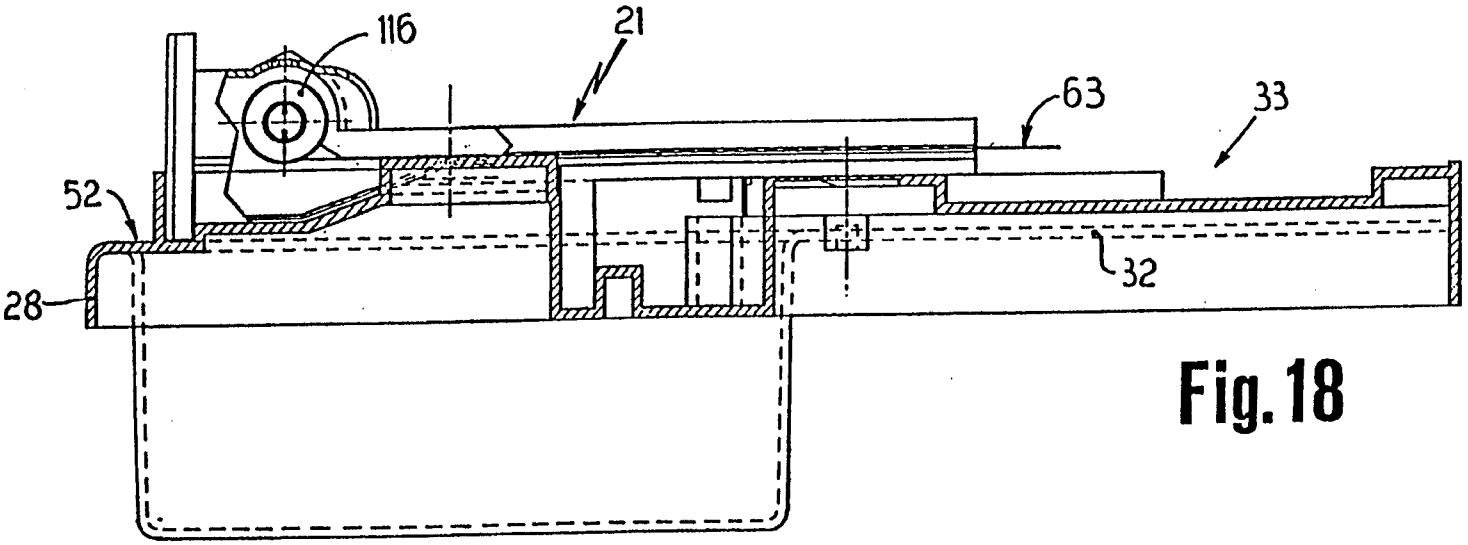

In addition, the seat 33 defines cavities having different shapes and depths, adapted to accommodate the correspondent magazine 21 in either of two different positions of such magazine, namely a first position in which the magazine rests on the right side of the seat 33 (which position is shown in FIGS. 15–17) and a second position in which the magazine rests on the left side of the seat 33 (which position is shown in FIGS. 16–18).

Moreover, at the bottom of seat 33 is fitted a cutter 41 or similar cutting tool, which can be actuated by a lever 331 in order to perform functions hereinafter described. The cutter 41 is disposed in such a manner as to coincide with a correspondent through-hole 42 of the overhanging magazine 21, when it rests on the seat 33 in the first position thereof (see FIG. 15).

In turn, the seat 34 is preferably rectangular and is provided adjacent the back edge 43 and left side edge 44 of the flat table 32 in order to accommodate at least a conventional tape dispenser 45 (see FIGS. 3 and 8) therein. The tape is of the kind normally used for connecting the films to be developed to leaders and is capable of withstanding the chemical treatment baths and the drying temperatures during the different treatment steps in which the films pass through the various stations of the developing machine.

Figure 8:
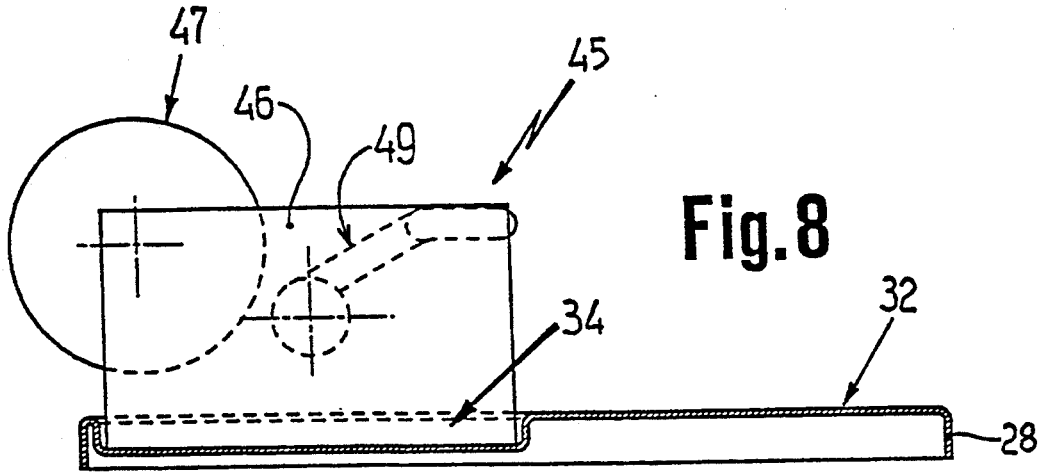
Figure 3:
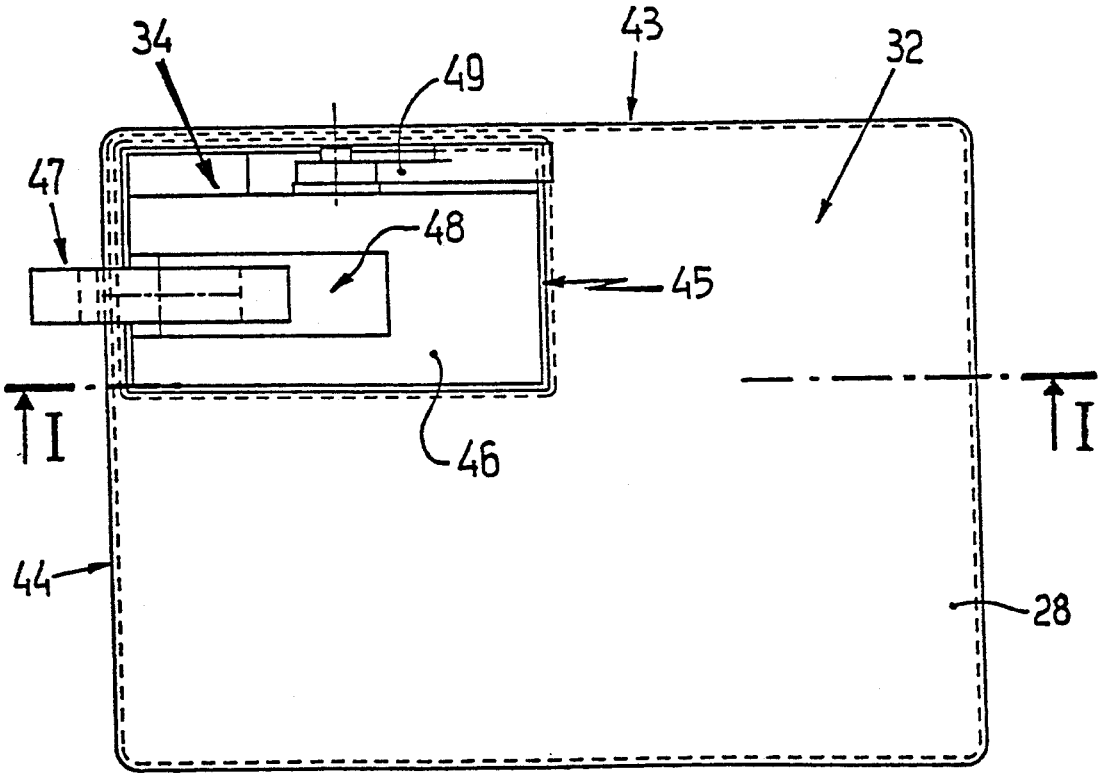

As shown in FIGS. 3 and 8, such tape dispenser comprises a parallelepipedal base 46 insertable into the seat 34, and which rotatably supports a roll of tape in a central cavity 48 thereof. A shaped arm 49 projects sideways from the base in order that predetermined portions of tape of a desired length may be unrolled and cut. The dispenser is of a per se known kind.

Figure 2:
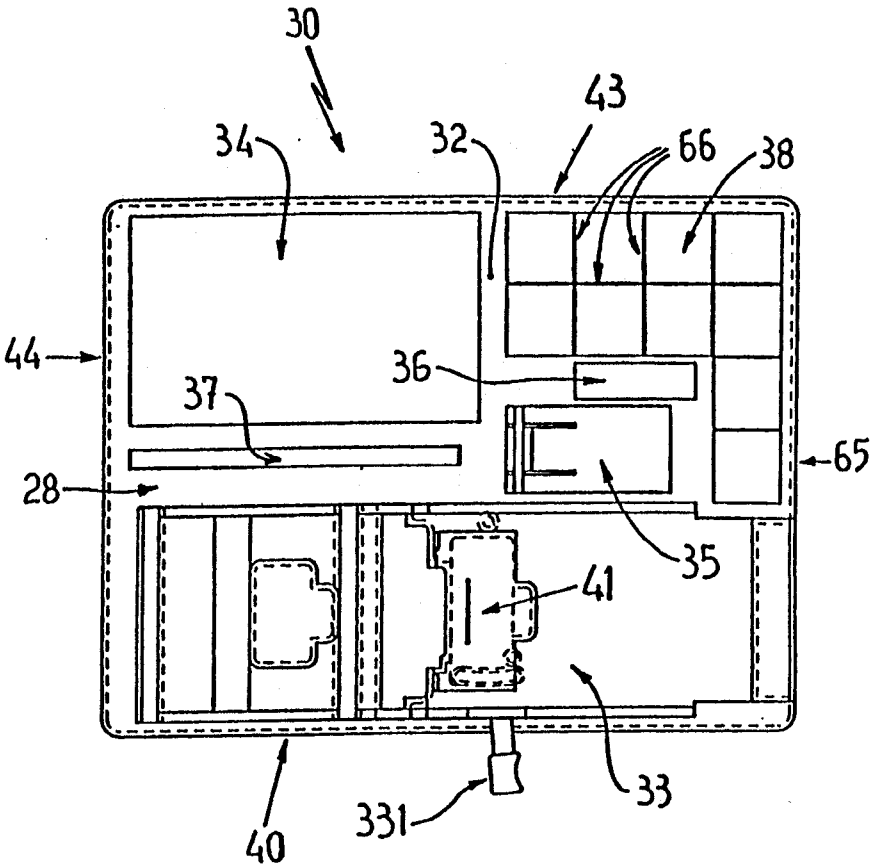
FIG. 2 is a plan view of the device for preparing film magazines.
Figure 9:
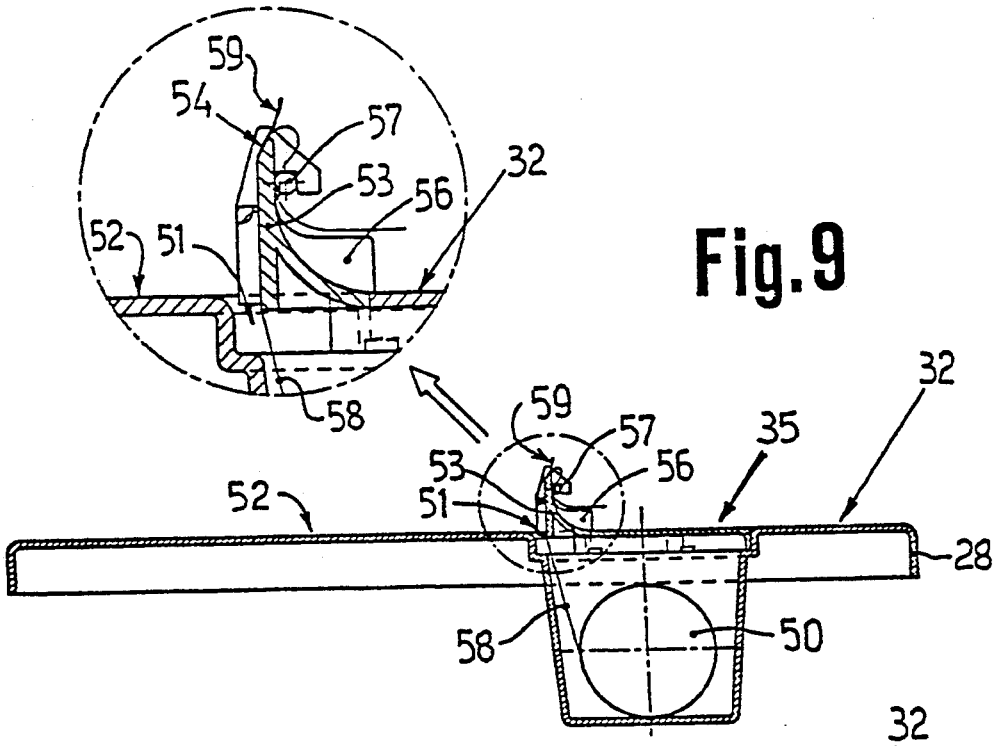
Figure 4:
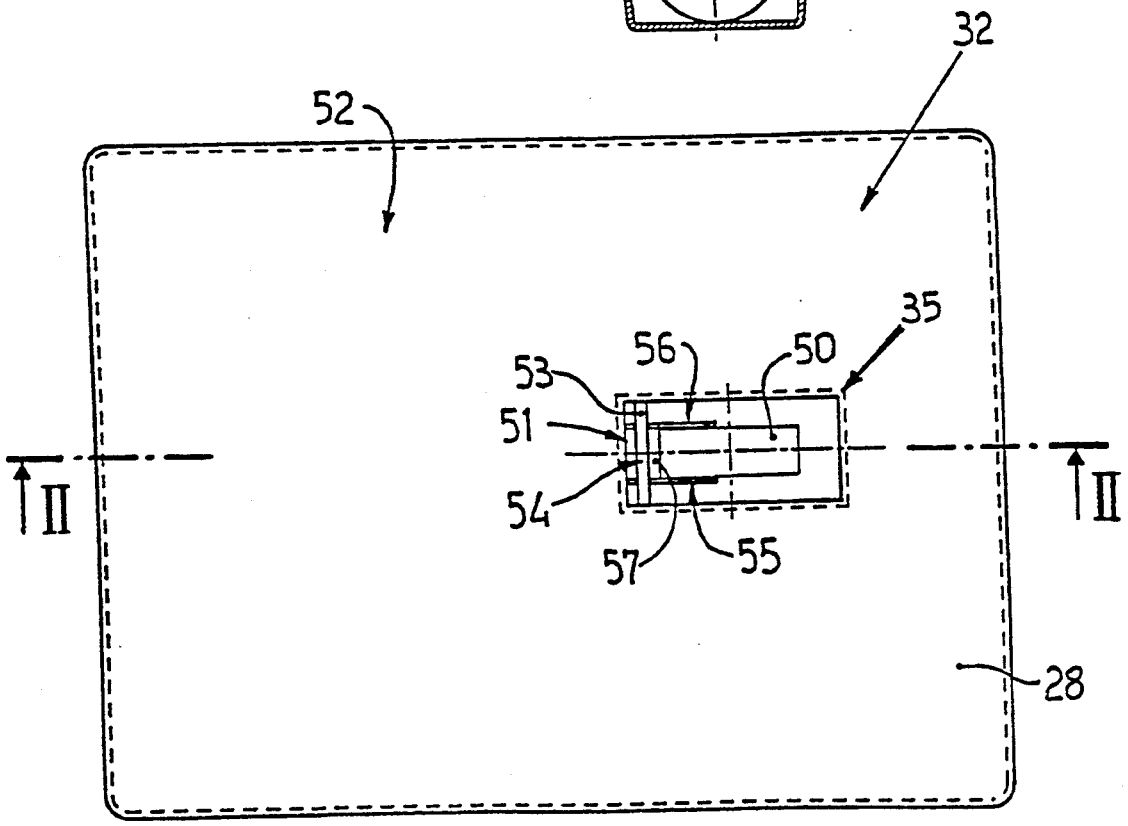

As can be seen from FIG. 2 and particularly from FIGS. 4 and 9, the seat 35 defines a parallelelpipedal cavity extending parallel and adjacent to the seat 33. The seat 35 has such a depth as to be able to accommodate a dispenser roll 50 therein for dispensing self-adhesive labels 59 for identification of each film. Such labels 59 are adhered with a suitable glue at regular intervals on a correspondent support band 58 and may be picked up separately therefrom for use.

As particularly shown in FIGS. 4 and 9, such dispenser roll 50 is arranged inside the seat 35 and the band 58 may be gradually extracted therefrom through a correspondent adequately sized groove 51, defined at the flat upper surface 52 of the table 32 by a vertical wall 53 connected to the flat upper surface 52 and provided with a beveled end 54 extending over the entire width of the same wall.

Moreover, the vertical wall 53 is laterally delimited by two identical side walls 55, 56 extending parallel to each other and projecting vertically from the upper surface 52. A horizontal short shaft 57 extends between the side walls 55, 56 at a close spacing from the surface of the vertical wall 53 so as to define a slit into which the end of the band 58 for supporting labels 59 is inserted. This band 58 has been passed in advance over the beveled end 54 in such a way that, when the support band 58 together with the associated labels 59 arrives at the beveled end 54 of the vertical wall 53, the correspondent label 59 is automatically detached from the same band 58 (see enlarged item of FIG. 9) and thus may be easily picked up therefrom and applied on the film to be identified.

Next, the seat 36 (see again FIG. 2 and particularly FIGS. 5 and 10) also defines a parallelepipedal cavity and extends near the previously described seat 35. The seat 36 has such a depth as to be able to accommodate an extractor 361 of film tangs (of films of size 135) of a per se known kind.

Figure 11:
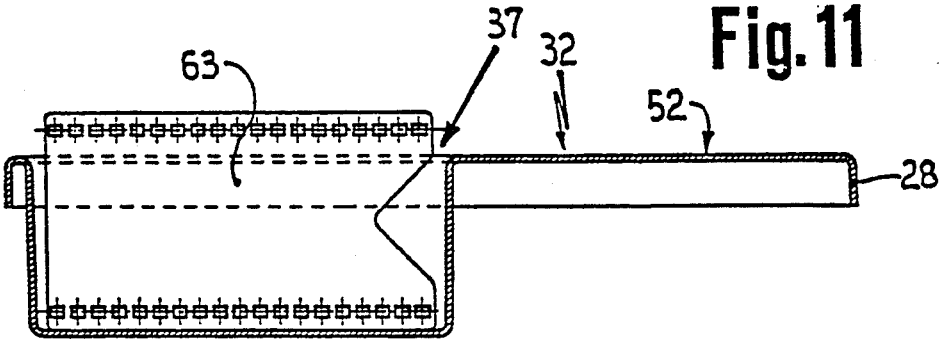
Figure 6:
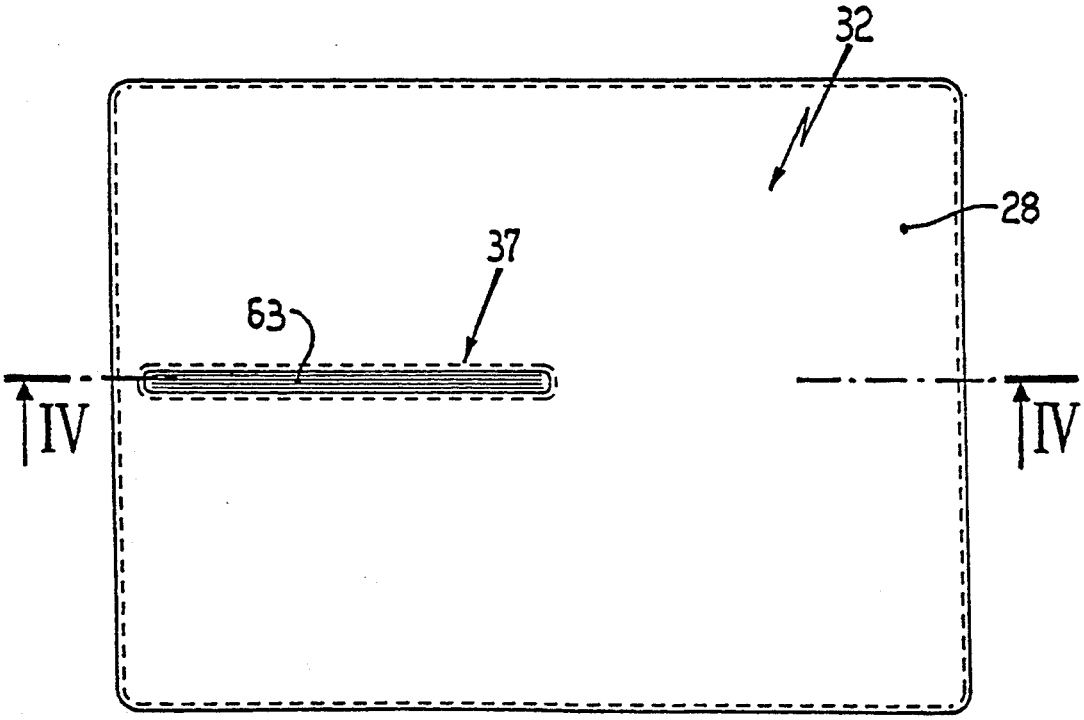

Referring again to FIG. 2 and particularly to FIGS. 6 and 11, seat 37 also defines a parallelepipedal cavity and is interposed between the seats 33 and 34.

The function of the seat 37 is to be able to accommodate a plurality of "leaders" 63 of a conventional kind therein which are placed side by side and may be easily extracted therefrom for their normal use.

Finally, still referring to FIG. 2 and particularly to FIGS. 7 and 12, the seat 38 defines a cavity extending near the back edge 43 and the right hand side edge 65 of the flat table 32. A plurality of vertical partition walls 66 extend orthogonally within the seat 38 so as to cross each other and thus define respective separated rooms for accommodating respective containers 67 for the film to be developed. These containers 67 are of a per se known kind which are so shaped and dimensioned as to be able to house films of any size.

The introduction of film into the container 67 is effected inside the lightproof station 27 by transferring the film from the winding reel or roll to the container 67, which then is extracted from the station 27 and is fitted to the magazine 21 whereby the film to be developed can be connected to a correspondent "leader".

Advantageously, film of any size may be introduced within the container 67, whose end will be connected as described hereinafter to the end of a leader without the danger of undesired exposure thereof to light.

Figure 13:
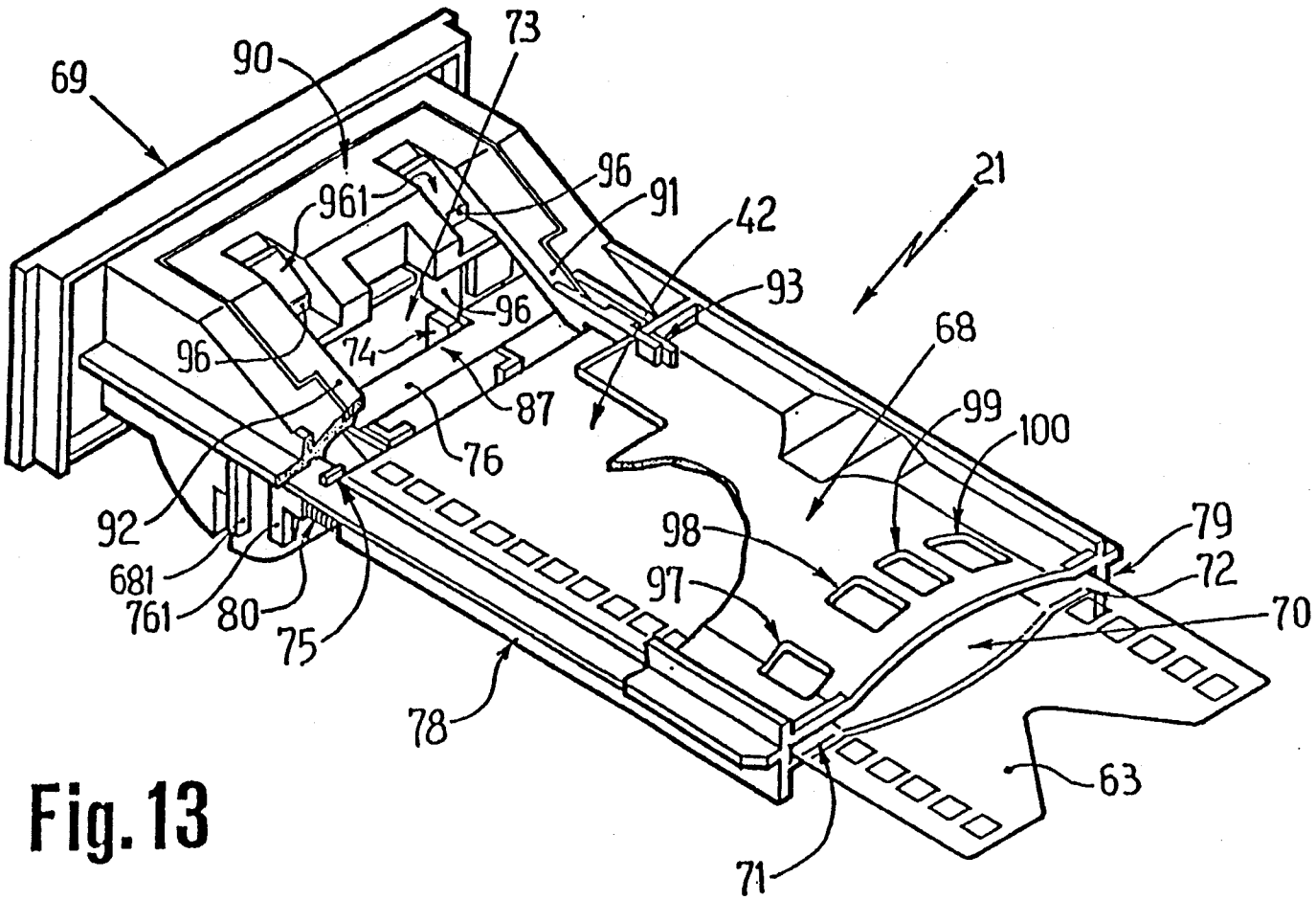
FIG. 13 is a perspective view, partially broken away, of the film magazine of the present invention, taken from the end thereof which is to be introduced first into the film developing machine.
Figure 14:
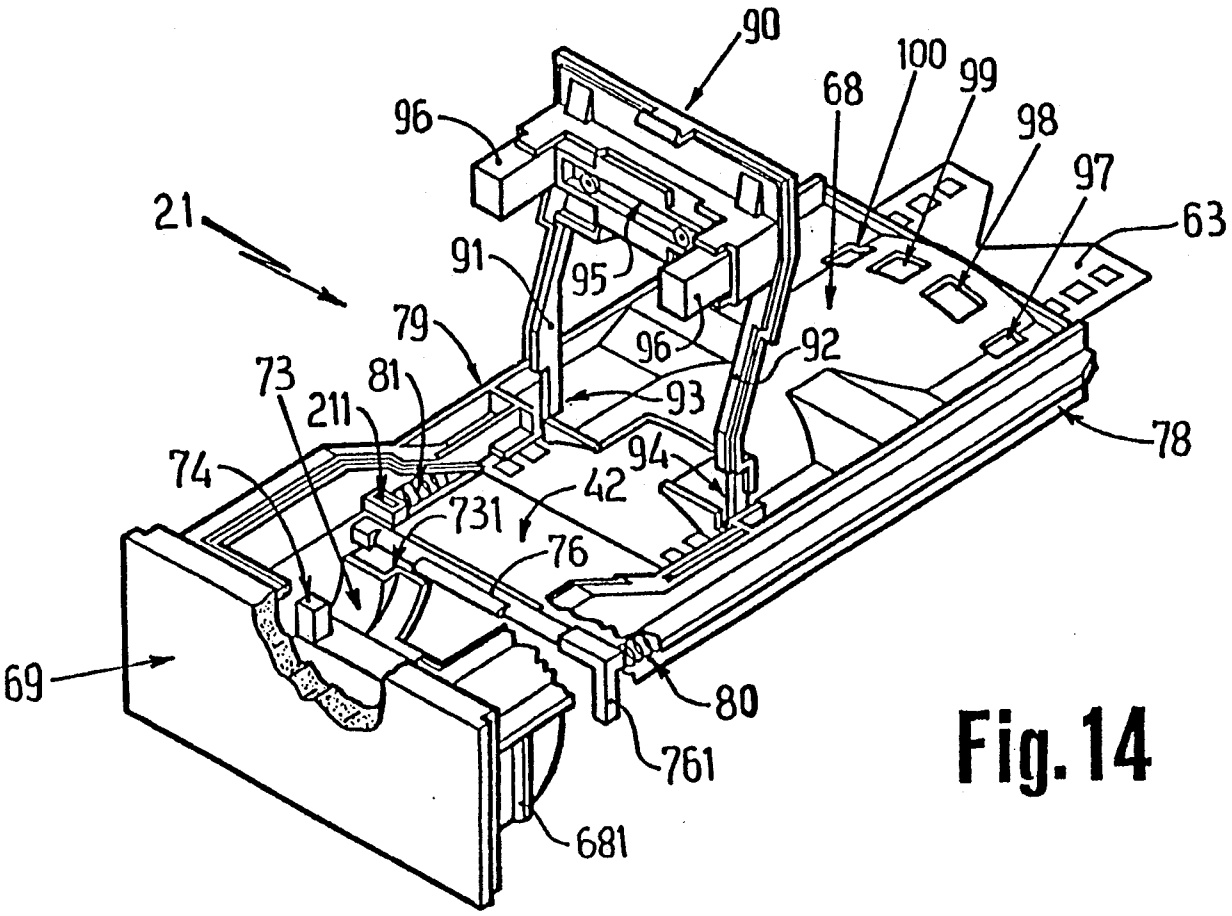
FIG. 14 is also a perspective view, partially broken away, of the same film magazine, but taken from the opposite end thereof and with the lid thereof opened.

Now referring to FIGS. 13 and 14, the film magazine 21 is constituted by a flat plate 68 (first plate-like member) having a parallelepipedal shape and small thickness, preferably formed of two half plates made of plastic material joined together in a per se known manner, and a flat plate 69 (second plate-like member) integral with and extending orthogonally to plate 68 so as to form the front of the magazine 21.

In particular, each of the two half plates forming flat plate 68 have a curved convex profile at a transverse central portion thereof, thus defining a longitudinal central opening 70 and two longitudinal grooves 71 and 72 adequately dimensioned to permit the insertion of the leaders 63 therein. Moreover, the flat plate 68 defines, at a transverse central location contiguous to the front plate 69, a space 73 having a semi-circular bottom.

Such space 73 is delimited at its sides by two flanges 681 which, as described later, will bear against the correspondent spring pushing elements 121 and 122 when the magazine 21 is inserted in the opening 31 of the box-like casing 118. Furthermore, the space 73 is so dimensioned as to accommodate a roll 116 of film of size 135 or, in the case of films of a size other than that, of a container 67 therein in which a correspondent film has been introduced in advance.

In particular, in order to permit a correct accommodation of the above-described container 67, two side projections 74 constituting two correspondent guide members are provided at the sides of the space 73 adjacent the bottom thereof. Side flanges 108 and 109 provided on the sides of the container 67 are engaged with the side projections, respectively (see FIGS. 22 through 26).

The shape of the container 67 and the insertion of the films to be developed therein as well as the accommodation of the films of different sizes in the space 73 of the magazine 21 will be described hereinafter in detail. The flat plate 68 is provided with a through-hole 42 extending over almost the entire width thereof and open to the space 73. The leader 63 is exposed at opening 42 and bears against a stopping element 75 when it is fully inserted in the longitudinal opening 70 (FIG. 13).

A pushing bar 76 is provided at the front edge 731 delimiting the through-hole 42. The pushing bar 76 has a length which is greater than that of the through-hole 42 and whose ends extend freely in respective holes provided in longitudinally extending opposite sides 78 and 79 of the flat plate 68.

Moreover, the ends of pushing bar 76 engage two pushing springs 80, 81 housed within respective guiding cavities. A projection 761 extends from at least one of the ends of the pushing bar 76 so as to engage a lever of a microswitch 132 for reasons set forth below.

The pushing bar 76 is biased towards the space 73 in the magazine 21 by the action of the pushing springs 80 and 81 so as to be pressed against either the roll 116 of a film of size 135 or the film container 67 which has been introduced into said space 73.

Furthermore, two side projections 211 are provided at the sides of said front edge 731, in front of the pushing bar 76. Side ears 111 of the container 67 rest on these projections 211, in the manner hereinafter described, when the container is inserted into the space 73.

Figure 19:
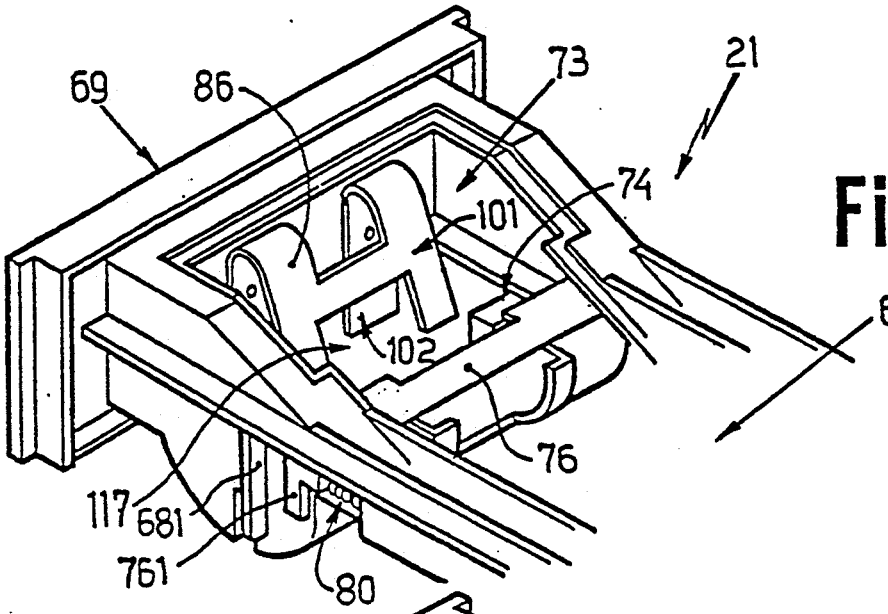
FIG. 19 is a perspective view of that portion of the magazine of FIG. 13 which defines a film container insertion space.

As particularly seen from FIG. 19, a leaf spring 86 or the like correctly positions either the roll 116 or the film container 67 within the space 73. The leaf spring 86 or the like is fitted in a per se known manner to the surface of the flat plate 69 and projects into the space 73. The leaf springs 86 pushes either the roll 116 or the film container 67, which are selectively introduced between the spring 86 and the pushing bar 76, in a direction opposite to that in which the pushing bar 76 is biased by springs 80, 81.

In addition, the central part of the free end of the leaf spring 86 defines a rectangular recess 117 so dimensioned as to be able to hold a roll 116 of a film of size 135, as clearly shown in FIG. 21 and hereinafter described more in detail.

Moreover, the magazine 21 is provided with a movable closing door 90 (FIGS. 13 and 14) which can cover the space 73 so as to contain each roll 116 or container 67 introduced therein. The closing door 90 has a one piece member including two thin side strips 91, 92 pivoted at their respective free ends on respective seats 93, 94 provided on the upper part of the flat plate 68 alongside the through-hole 42.

A movable contact element 95 is housed within a seat provided on the underlying surface of the door 90 and is mounted thereto by per se known fixing means so as to be capable of shifting with a short stroke perpendicularly to the flat surface of the door.

This contact element 95 is provided with two lower end side projections 96 adapted to engage, when the door 90 is closed, the side flanges 108 and 109 of the film container 67 occupying the space 73 as described hereinafter in more detail. Upper ends of the contact element 95 define inclined surfaces 96 adopted to engage respective inclined surfaces 313 of an extended box-like casing 118 of the loading station 23.

In order to be able to introduce or extract either a roll 116 or a film container 67 into or from the space 73, the door 90 is pivoted about its hinge pins, thus causing the door to be displaced from the closed position to an opened position thereof (located about 180° apart from one another), where it rests on the upper surface of the flat plate 68.

Therefore, the free end of the film to be developed may be seized from each roll 116 or film container 67 so positioned in the magazine 21. This end is passed over the pushing bar 76 and through a central guide opening 87 provided between the bar 76 and the door 90 of the film magazine 21. After the door 90 is closed, the tang of the film of size 135 is cut, connected to the leader 63 and provided with one of the identification labels 59, as described hereinafter in more detail.

Finally, the magazine 21 is provided with a plurality of through-holes 97, 98, 99, 100, aligned with each other in the transverse direction of the magazine 21 near the end of the flat plate 68 at which the leader 63 is introduced. The function of the through-holes 97, 98, 99, 100 is to permit the size of film introduced in the magazine 21 to be identified by conventional photosensor elements, such as reflection photodetectors or similar optoelectronic components, disposed at positions corresponding to the same openings and provided in the developing machine. These photosensor elements are operatively connected to an electronic circuit of the machine in order to be able to automatically set the duration of the developing steps performed by and the regeneration of the treatment baths depending on the kind of film so identified.

Figure 29:
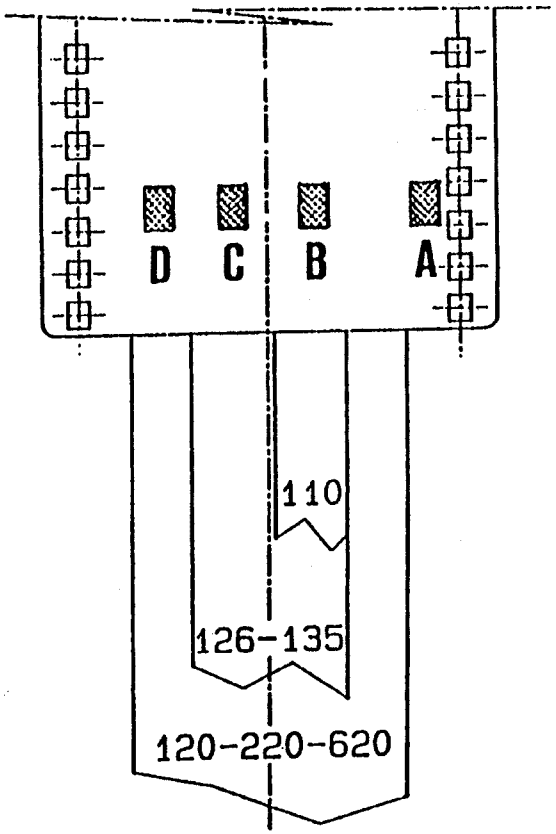
FIG. 29 schematically illustrates different sized films positioned on a leader.

The arrangement of the through-holes 97, 98, 99, 100 and thus of the associated photosensor elements are set based on the manner in which the films are to be connected to the respective leaders, as clearly illustrated by FIG. 29. In particular, with reference to FIG. 29 as well as to FIGS. 13, 14 and 27, it is noted that the photosensors all detect the presence of a diaphragm, which photosensors are located at positions schematically indicated in FIG. 29 by the letters A, B, C and D and respectively corresponding to the through-holes 97, 98, 99, 100. The presence of the leader can thus be detected upon the operation of the machine. More specifically, the detection of the presence of a diaphragm will be permitted in advance by photosensor A only (since the other photosensors are ineffective due to the recess at the front end of the leader 63). Afterwards, when the leader is moved forward beyond the photosensors, the presence of a film of size 120, or 220 or 620 is detected in the following way.

When the photosensor A does not generate a signal and the photosensors B, C, D all detect the presence of a diaphragm, the presence of film of size 120, 220 or 620 is signaled. When the photosensors B and C detect the presence of a diaphragm, the presence of films of size 126 or 135 is signaled.

Finally, when only the photosensor B detects the presence of a diaphragm, the presence of film of size 110 is signaled.

Now referring to FIGS. 15, 16, 17 and 18, the magazine 21 is placed on the upper surface of the flat table 32 in the seat 33 thereof to permit an end of a film to be developed to be connected to a leader 63 inserted in advance through the longitudinal opening 70 of the magazine.

In particular, as shown in FIGS. 15 and 17, the magazine 21 is provided by way of example with a roll 116 of a film of size 135. The magazine 21 is firstly laid on the right hand side of the seat 33 of the device 30, the closing door 90 is turned upwardly and the film is slightly extracted from its roll 116 upon extraction of its end tang, effected by means of a well known extraction device housed in the seat 36 of the flat table.

As shown in FIG. 16, such tang then is inserted in the opening 42 and a suitable portion of tape drawn from the dispenser 45 is affixed on the ends of the film and leader adjacent to each other at the through-hole 42, thus joining such ends together.

Thereafter, a label 59 for identifying the film is put thereon, which label is drawn in the above described way from the dispenser roll 50. Then, the tang is cut by operating the lever 331 of the cutter 41.

Afterwards, the magazine 21 is moved to its other position at the left hand side of the seat 33, as shown in FIGS. 16 and 19. Next, another portion of tape is affixed on the outer surfaces of the film and leader, thus providing another joint of these ports.

Thus, the magazine 21 is ready for being inserted in the opening 31 of the loading station 23 of the film developing machine for developing such film in a conventional manner. Reference is now made to the FIGS. 19 through 23, in which the use of a roll 116 of film of size 135 as well as of the container 67 of films of different sizes are illustrated in detail.

Figure 20:
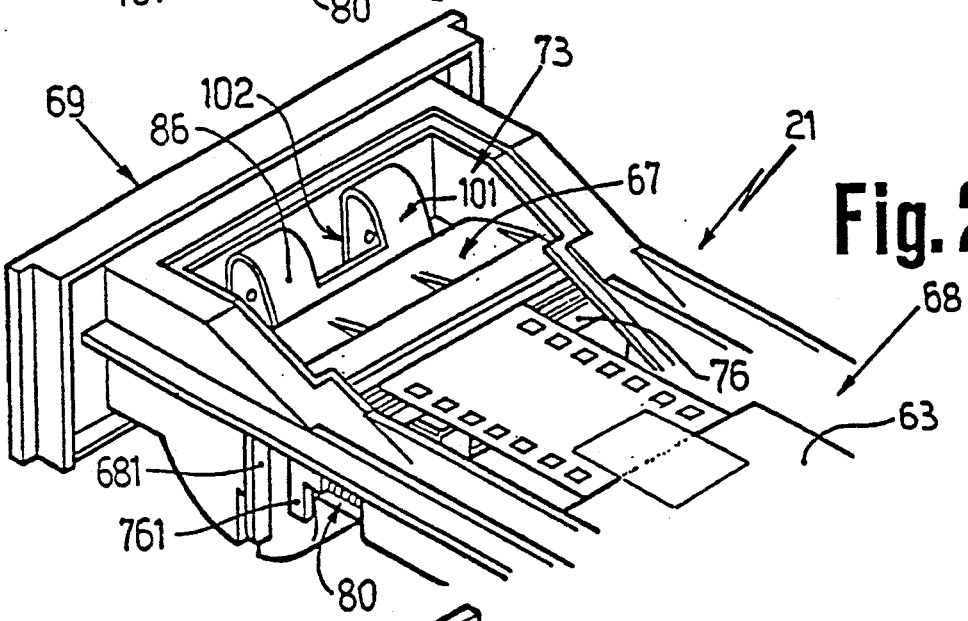
FIGS. 20 and 21 are perspective views similar to FIG. 19, but respectively showing a container for films of sizes different than size 135 and of a roll of size 135 film, received in the insertion space of the magazine illustrated in FIGS. 13 and 14.

Referring firstly to FIGS. 19 and 20, the container 67 in which the film to be developed is housed is introduced in the space 73 of the magazine 21, by arranging it against an inclined part 101 of the leaf spring 86 which is joined to the vertical part 102 thereof. The container 67 is thus interposed between the leaf spring 86 and the pushing bar 76, which position the container within the space 73.

Figure 24:
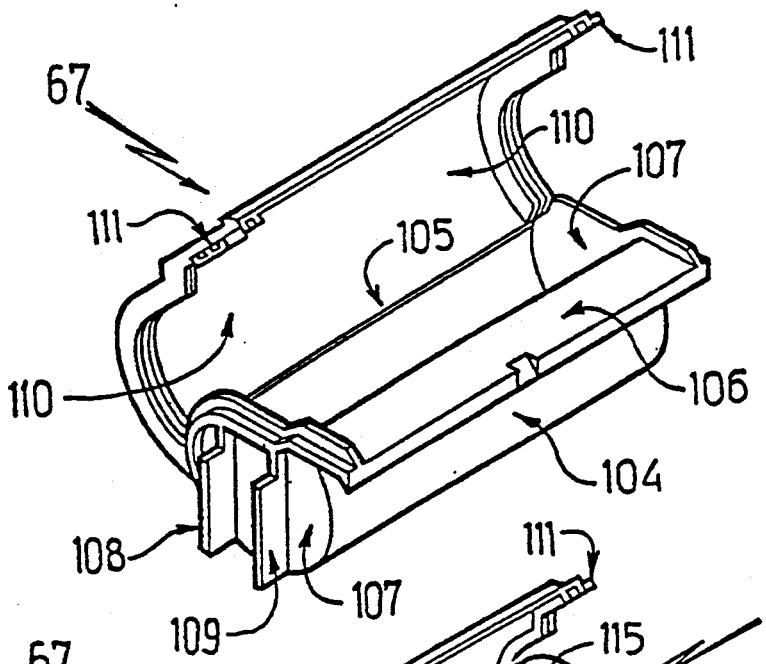
FIG. 24 is a perspective view of the container for films of sizes different than size 135, which container is insertable in the magazine illustrated in FIGS. 13 and 14.

As clearly pointed out particularly from FIG. 24, the container 67 substantially comprises two half-shells 104, 110 interconnected with each other. The first half-shell 104 is in the form of a semicylindrical casing connected at its front to a flat portion 106 and laterally closed by two circular diaphragms 107. Each of the diaphragms is provided on the outside thereof with two side flanges 108 and 109 extending vertically and spaced from each other. The flanges 108 and 109 receive the side projections 74 of the magazine thus preventing the container 67 from rotating during the unrolling of the film.

The second half-shell 110 is also in the form of a semicylindrical casing which is connected to the half-shell 104 along a line 105 providing an actual hinge constituted simply by a reduced thickness of the casing of the half-shell 104. The half-shell 110 can thus be opened and closed.

Two laterally projecting ears 111 are also provided at the sides of the front edge of the second-half shell 110. These ears 111 rest on the side projections 211 of the magazine 21 when the container 67 is received in the space 73 of the magazine 21.

Figure 25:
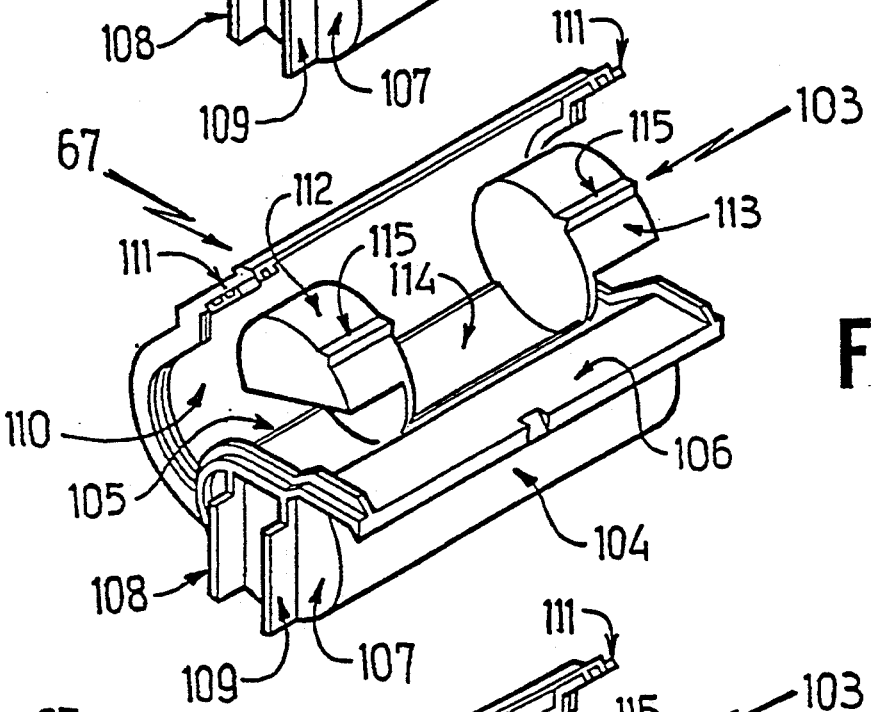
FIGS. 25 and 26 are perspective views of film containers provided with two different adapter elements for positioning films of different sizes therein.
Figure 26:
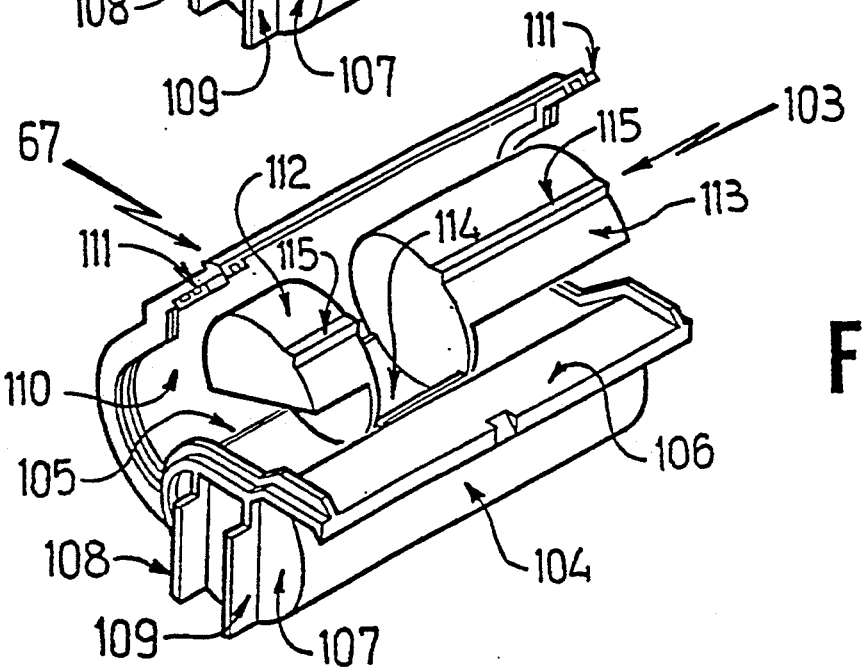

Either a roll of film of size 120 or, for other sizes of films, an adapter element 103 shown in FIGS. 25 and 26, may be introduced inside the cylindrical cavity defined between the half-shells 104 and 110. The adapter element 103 includes two semicylindrical portions 112 and 113 suitably spaced from each other and interconnected by another semicylindrical (arcuate) portion 114 in order to define a space therebetween (seat) in which the respective film to be developed (not shown) is accommodated.

In the present case, the adapter elements 103 of FIGS. 25 and 26 have spaces with different widths to accommodate respective films of different sizes. The elements 103 are also provided with a longitudinal rib 115 adapted to bear against the associated edge of the flat portion 106 of the container 67 in order to prevent the adapter element 103 from being rotated in its seat undesirably during the unrolling of the film.

More precisely, FIG. 25 illustrates an adapter for films of size 126, while FIG. 26 illustrates an adapter for films of size 110.

Moreover, the inner walls of both the container 67 and the adapters which are in contact with the films are adequately coated with suitable soft protecting material, such as velvet or the like, for preventing possible superficial damage of the films during their unrolling. The adapter elements 103 may obviously assume different shapes.

Figure 21:
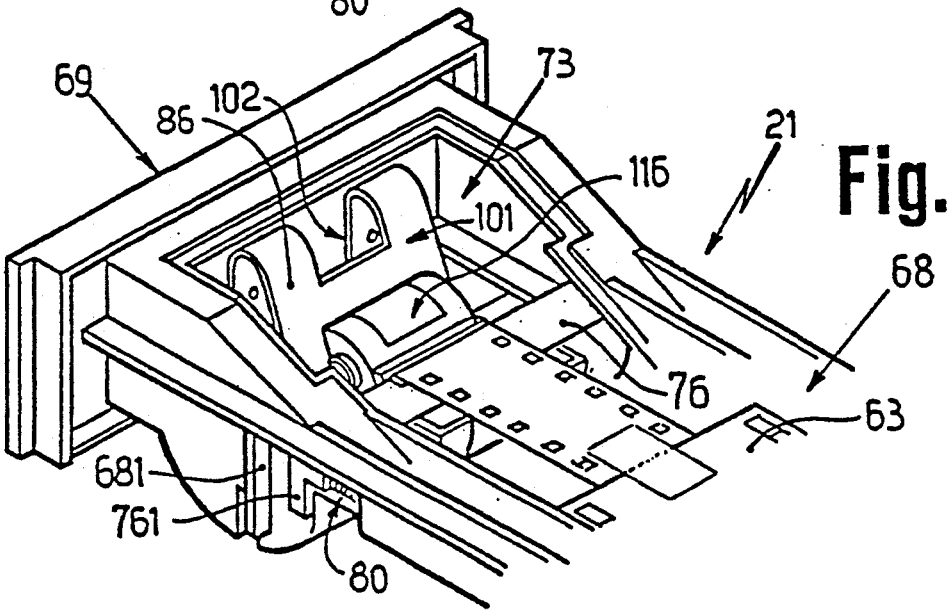

Reference is next made to FIG. 21 which shows the assembly of a roll 116 of film of size 135 in the space 73 of the magazine 21.

As can be seen from this figure, the container 67 is not used and such roll 116 is directly introduced within the rectangular recess 117 of the leaf spring 86 so as to be interposed between the leaf spring and the pushing bar 76 in order to permit the film to be unrolled from such roll. The operation of the device according to the invention is thus self-evident.

It is to be noted that when the original container for a roll 116 of film of size 135 is not utilizable for whatever reason, the container will be introduced in advance into the preparation station 27 of the developing machine. By acting through the flexible tubes 29, an operator can unroll the film from the container and then insert the film in a respective container 67 as received in an adapter element 103. The so loaded container 67 is then closed, thus keeping the film adequately protected in a dark ambient environment.

Thereafter, this container is removed from the preparation station 27 and is introduced into the space 73 of the magazine 21. This magazine is then put in the preparation device 30 so that the same film can be joined with the leader 63 in the previously described manner.

In the case in which the film to be developed is of size 135, there is no need to transfer the film into a container 67 in the preparation station 27. A roll 116 of such film may be directly introduced in the space 73 of the magazine 21.

At the end of each operation of joining a film to a respective leader, the movable door 90 is closed over either the container 67 or the roll 116 occupying the space 73 in the magazine 21. The magazine 21 is thus ready to be introduced in the side opening 31 of the loading station 23 of the machine.

Figure 27:
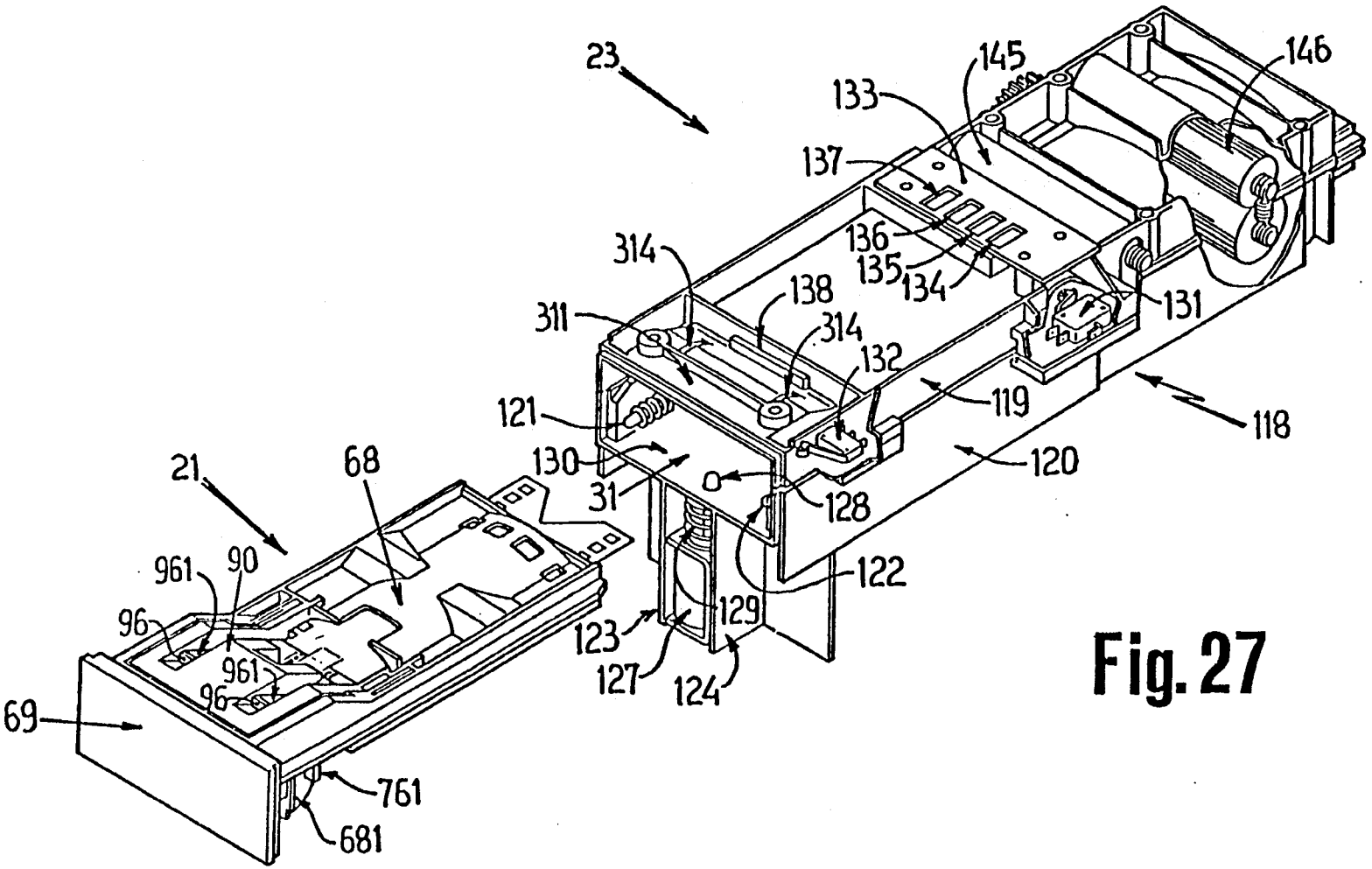
FIG. 27 is a perspective view, partially broken away, of the magazine disposed at a ready position near the loading station of a film developing machine.

FIG. 27 is a perspective view of a so predisposed magazine 21 about to be inserted in the opening 31 of the loading station 23 of the developing machine.

As can be seen from such FIG. 27, the loading station 23, illustrated as partially broken away, substantially comprises an extended box-like casing 118 which is adequately fitted in a per se known manner inside the film developing machine and is formed by two superimposed plate elements 119 and 120 joined to each other.

In particular, such plate elements 119 and 120 are so shaped as to define the opening 31 for receiving the magazine 21, which magazine 21 will penetrate the casing over about half the length thereof, and a space provided with suitable entrainment units. The entrainment units are in the form of pairs of cylindrical rolls 145 and 146, known per se, and operatively connected to correspondent driving means of the developing machine. The rolls 145 and 146 engage the leader and the film joined thereto for entrainment thereof inside the film developing machine.

Furthermore, at the opening 31 the box-like casing 18 is provided with two spring pushing elements 121 and 122, protruding from a transverse vertical wall (not shown) located below the opening for receiving the plate 68 of the magazine 21. The spring elements 121 and 122 engage the side flanges 681 of the magazine 21 when the magazine is fully introduced within the opening 31.

Clearly, such spring pushing elements 121 and 122 are urged inwards by such side flanges 681 so as to tend to urge the magazine 21 fairly outwards to a slightly extended position thereof with respect to the front of the box-like casing 118.

Figure 23:
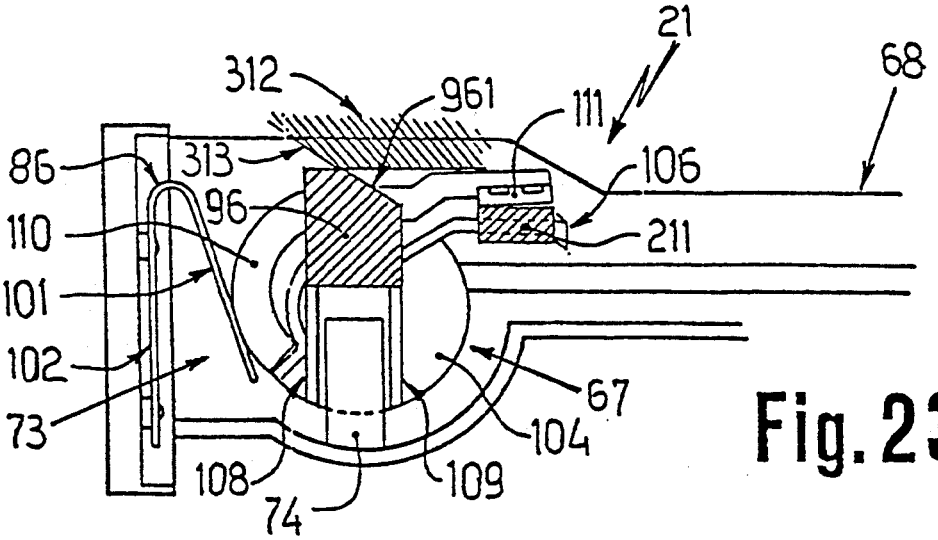

Two elements 312, not shown entirely in FIG. 23, and which are defined at the inner part of the cavities 314, project into the opening 31 from the transverse upper wall 311.

The front ends of the projecting elements 312 are beveled, thus provided inclined surface 313 which, as described later, engage the corresponding inclined surface 961 provided on the front part of the upper ends of the side projections 96 of the movable contact element 95.

In addition, two parallel flat walls 123, 124 spaced apart from each other extend vertically and perpendicularly below the lower wall 130 defining the bottom of the opening 31. Walls 123, 124 are integral with the box-like casing 118 and define a central space in which an electromagnet 127 oriented in vertical direction is housed. The core of the electromagnet 127 has a pin 128 at its upper part. The pin is urged upwards by a spring 129 and passes through a hole provided through the lower wall 130.

The pin 128 is aligned with a correspondent hollow (not shown) provided in the magazine 21 when the magazine 21 is inserted in the box-like casing 118 so that the magazine 21 will be locked by such a spring-biased pin. On the contrary, the magazine 21 will be unlocked by the pin when the electromagnet is energized, thus making such magazine easily extractable from casing 118 due to the outwardly acting pushing force exerted on the magazine 21 by the spring pushing elements 121, 122.

Moreover, the box-like casing 118 is provided with two electric microswitches 131 and 132 at the sides thereof. These switches 131, 132 are spaced from each other and are respectively actuated by the end part of the flat plate 68 of the magazine 21 and by the correspondent raised part 761 of the pushing bar 76 projecting from the magazine.

The microswitches 131 and 132 are connected in series to each other in the electrical circuit of the developing machine and allow the machine to operate only when both are switched on by the magazine 21 having been fully inserted in the opening 31 of the box-like casing 118. On the contrary, in the case in which only the microswitch 132, which is accessible from outside, is actuated, the machine will not operate thus providing an operation of safety for the operator.

Furthermore, an electronic card is provided on the upper part of the box-like casing 118 at a position which will coincide with the location of the terminal part of the flat plate 68 when the magazine 21 is fully inserted in the box-like casing 118. The electronic card substantially comprises a plate 133 provided with a set of photosensors (not shown) disposed over through-holes 134, 135, 136 and 137 in the casing which will align with the through-holes 97, 98, 99 and 100 in the flat plate 68 When the magazine 21 is fully inserted in the box-like casing 118.

The photosensors are adapted to detect, in a per se known manner and as described later, the size of each film to be developed and consequently to effect the operation, also in a per se known way, of the regeneration of the various film treatment baths. Furthermore, the box-like casing 118 is provided with a cutter 138

Figure 28:
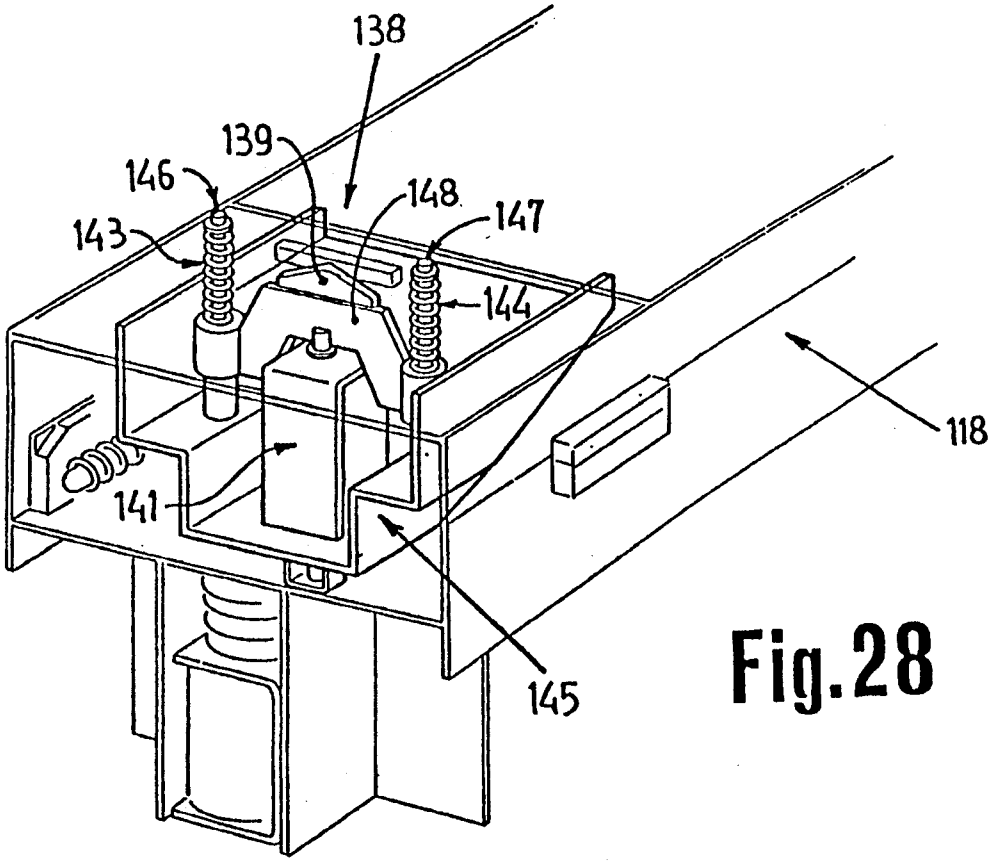
FIG. 28 is a perspective view of a cutter of the loading station.

(FIG. 28) located in a position which will coincide with the through-hole 42 of the magazine 21. When the magazine is fully inserted into the casing, the cutter is adapted to cut the terminal end of the film of size 135 when the film is fully extracted from the roll occupying the space 73 of the magazine 21. As particularly shown in FIG. 28, the cutter 138 is constituted by a blade 139 supported by a vertically slidable transverse plate 148. The plate 148 rests on the movable core of an electromagnet 141 housed within a casing 145 connected to the bottom of the box-like casing 118.

The transverse plate 148 is slidably guided by two side guiding studs 146 and 147 engaging bushes of the plates and is biased downward by pushing springs 143 and 144 to locate the blade 139 at its rest position in which it is retracted and does not act on the film.

In turn, the electromagnet 141 is connected to the electric circuit of the machine and is energized only when the unrolling of a film of size 135 is completed. At this time, the movable core thereof is pushed upwards, against the action of springs 143 and 144 which are compressed, and the blade 139 abuts the film thus cutting the terminal end thereof.

The cutter 138 is operated only when the magazine 21 accommodates a normal roll of film of size 135 in which, as is known, the film is connected to a reel. In this case, when the film is fully withdrawn from the roll 116, it entrains the roll 116 which consequently pushes the pushing bar 76 forward.

In turn, the pushing bar 76 abuts the raised part 761 of the control lever of the microswitch 132, thereby turning the microswitch 132 on. Due to the fact that the microswitch 131 is also turned on because the magazine 21 is positioned in the box-like casing 118, the cutter 128 is actuated and cuts the terminal end of the film. The film is thus detached from the reel and may continue to be drawn into the film developing machine.

Finally, referring to FIG. 27 again, the box-like casing 118 is provided with two pairs of cylindrical rolls 145 and 146 disposed side-by-side and rotating in opposite directions to each other. These rolls, as already described, are rotatably driven by per se known driving members and are situated along the box-like casing 118. The rolls of each pair of cylindrical rolls 145, 146 are biased against one another by suitable springs so as to cause the frictional entrainment of the leaders and of the films connected thereto and the subsequent transfer thereof toward the chemical treatment baths and the drying zone of the developing machine (not shown).

The use of the magazine 21 is as follows.

By fully inserting a magazine 21, predisposed in the above-described manner, in the box-like casing 118, the raised parts 761 of the magazine 21 bear against the spring pushing elements 121, 122, Which are then compressed. The spring pin 128, which projects slightly into the recess of the magazine 21, fixes the magazine 21 to the box-like casing 118.

Figure 22:
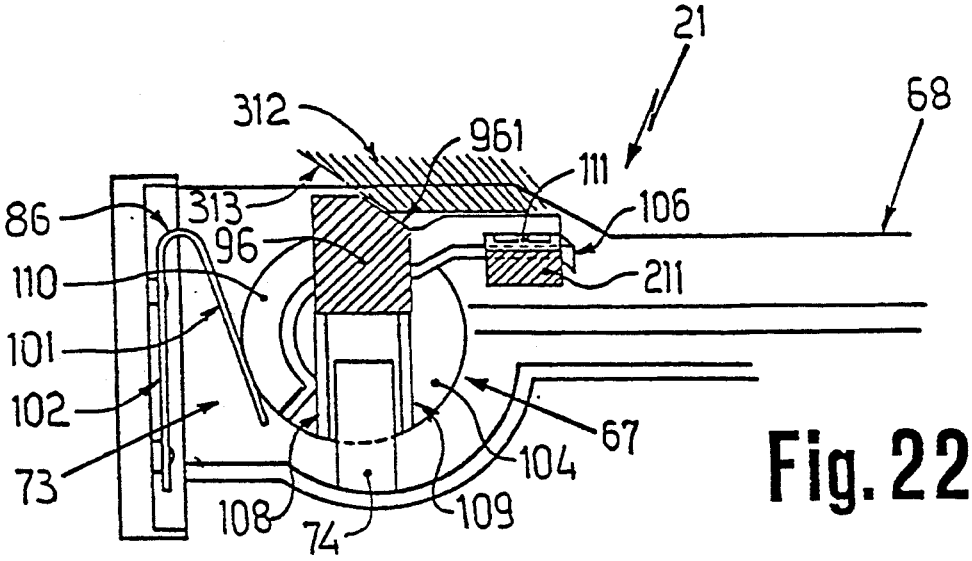
FIGS. 22 and 23 are schematic cut-away side views of portion of the magazine, having the container for films of sizes different than the size 135 received therein, as disposed at a position prior to its insertion in the film developing machine and in the full insertion position thereof, respectively.

Moreover, as clearly shown in FIGS. 22 and 23, when the magazine 21 is almost fully inserted in the casing 118 and has a container 67 of film fitted therein, the inclined surfaces 313 of the projecting elements 312 of the casing 118 contact the inclined surfaces 961 provided on the front part of the upper ends of the side projections 96 of the movable contact element 95. Therefore, the projections 96 which, when the cover is closed engage the upper ends of the side flanges 108 and 109 of the container 67, push such flanges 108 and 109 downwards. Thus, the first half-shell 104 is moved downwards too.

Due to the fact that the side ears 111 projecting laterally from the front edge of said second half-shell 110 rest on the respective side projections 211 of the magazine 21, it follows that the flat portion 106 projecting from the first half-shell 104 is moved away from the opposite front edge of the second half-shell 110 so that the container 67 is opened to access the film. The film may thus freely leave the container 67 when such film is entrained in the film developing machine 20. At the same time, the magazine 21 turns the microswitch 131 on thus signaling the presence of the magazine 21 to the microprocessor which controls the operation of the machine.

The starting operation of the machine also depends, as already stated, on the presence of the leader in the magazine which is detected by the photodetector A. In addition, the operation of the machine proceeds depending on the state detected by the photodetector elements, whose arrangement allows the kind of film being passing through the machine to be detected and thus are used to establish the transit times thereof. The microprocessor of the machine regulates and controls all of the operations involved depending particularly on the size and the length of the films. For instance, the regeneration of the various chemical treatment baths will be appropriately carried out under the control of the microprocessor.

When the photodetector elements of the film developing machine detect a lack of film, the microprocessor continues to control the operations already in progress and at the same time energizes the electromagnet 127. This causes the spring pin 128 to be brought out of the recess of the magazine 21 so that the magazine 21 is disengaged from the box-like casing 118. The two spring pushing elements 121 and 122 thus push the magazine 21 slightly outwards, whereby the magazine 21 may be seized by the operator and extracted from the box-like casing 118.

As is readily understandable, the machine obviously stops upon the completion of the various treatments of the film, unless another magazine in the meantime has been inserted into its loading station.

Thus, the advantages of the device according to the invention appear evident.

In fact, due to the particular shape of this device for preparing film magazines, a limited space may nonetheless accommodate all of the tools and materials required to join the different sized films to respective leaders. Such work is effected easily by acting directly on a magazine of the present invention.

Further, the insertion of films in the associated magazines, their joining to the respective leaders, and the displacement of the so prepared magazines from the preparation station to the loading station may be effected in a rational, easy and safe manner. In particular, the danger of the film from slipping out of the associated containers during the transfer thereof is avoided.

Furthermore, the containers and the adapter elements allows not only film of size 135 to be developed but also films of different sizes. All sizes of film may be accommodated in a magazine of the present invention which has a simple structure and can introduce the films into the conventional developing machines in a safe, simple and reliable, and in some cases, in a fully automatic, manner.

In fact, the loading station of the film developing machine could be advantageously provided with a suitable automatic loading device, adapted to automatically sequentially feed magazines of the present invention into the developing machine.

Clearly, such a loading device could take various forms. For instance, the magazines could be disposed circumferentially on a suitable circular support, which automatically positions the magazines at the loading station where an appropriate kinematic device automatically controls the insertion and removal of the magazines. In this case, the assembly will be obviously connected to and controlled by the film developing machine.

Other variations and modifications of the present invention will become apparent to those of ordinary skill in the art. Therefore, such variations and modifications are to be understood as falling within the true spirit and scope of the invention as defined by the appended claims.

We claim:

1. Apparatus for preparing film for insertion thereof into a film developing machine, said apparatus comprising: a preparation station including a table having a plurality of seats; a plurality of film contains capable of receiving films of different sizes, a plurality of film leaders, film splicing material capable of joining film to the leaders, film identification, and a magazine all received in the seats of said table; and said magazine defining a film insertion space therein of dimensions corresponding to those of said film containers such that said film containers are individually insertable into said magazine within said film insertion space.

2. Apparatus as claimed in claim 1, wherein said table is disposed at an uppermost portion of said preparation station, said seats are defined within the upper surface of said table, and said film containers, said film leaders, said film splicing material, said film identification and said magazine are received within respective ones of said seats.

3. Apparatus as claimed in claim 2, wherein the respective seat in which said magazine is accommodated is defined by surfaces of said table which can position said magazine at two different locations in said respective seat offset from one another, and wherein said preparation station further comprises a film cutter extending within the respective seat in which said magazine in accommodated.

4. Apparatus as claimed in claim 2, wherein said film identification comprises a support tape, self-adhesive labels detachably adhered to said support tape, and a dispenser roll around which said support tape is wound, said dispenser roll being disposed in a respective one of said seats, and wherein said table includes a vertical wall extending above said respective one of said seats in which said support roll is disposed, said vertical wall having an upper beveled end, whereby said support tape is with drawable from said support roll over the beveled end of said vertical wall to facilitate the separation of said labels from said support tape.

5. Apparatus as claimed in claim 2, wherein said table includes a plurality of partition walls extending vertically and orthogonally to one another within the respective seat in which said film containers are received.

6. Apparatus as claimed in claim 1, wherein said magazine includes a first plate-like member having an opening extending transversely therein which forms said film insertion space, a second plate-like member integral with and extending perpendicular to said first plate-like member at a front end thereof, and a door hinged to said first plate-like member so as to be pivotable between respective positions at which said door covers and uncovers said film insertion space, said first plate-like member also having an opening extending longitudinally therein ad of a width corresponding to that of said film leaders such that said film leaders can be individually inserted into said first plate-like member, said first plate-like member also having a through-hole extending therein and open to the longitudinally extending opening so that a leader fully inserted in said first plate-like member will be exposed at said through-hole, and said first plate-like member also having a plurality of additional through-holes extending therein and open to the longitudinally extending opening, said additional through-holes spaced from one another in the transverse direction of said first plate-like member.

7. Apparatus as claimed in claim 6, wherein said magazine further includes side projections provided at opposite sides, respectively, of said film insertion space, and first and second resilient members provided at opposite ends, respectively, of said film insertion space as taken in the longitudinal direction of said first plate-like member, said resilient members being spaced from one another by such a distance that when one of said film containers is disposed in said film insertion space as interposed therebetween, said resilient members exert respective biasing forces in opposite direction toward one another to maintain the container in position in said film insertion space.

8. Apparatus as claimed in claim 7, wherein said first plate-like member also has holes extending longitudinally in the respective sides thereof, and said first resilient element comprises a pushing bar extending transversely of said first plate-like member and springs biasing said pushing bar in a direction toward said second resilient member, said pushing bar having respective ends received in said holes extending longitudinally in the respective sides of said first plate-like member.

9. Apparatus as claimed in claim 7, wherein said second resilient element comprises a leaf spring having a first vertically extending part fixed to a surface of the magazine delimiting said film insertion space and a second part inclined relative to said first part.

10. Apparatus as claimed in claim 9, wherein the second part of said leaf spring has a recess therein sized to accommodate a roll of film of a standard size therein.

11. Apparatus as claimed in claim 9, wherein said film containers each include first and second articulated half-shells, and flanges extending on respective sides of the first half-shell, said flanges of each respective said film container engaging said projections of the magazine when said respective film container is inserted in the film insertion space of the magazine, and further comprising adapters enclosable within the half-shells of the containers, said adapters capable of receiving films of different sizes.

12. Apparatus as claimed in claim 11, wherein each of said adapters includes two semi-cylindrical portions axially spaced from one another, and an arcuate portion interconnecting said semi-cylindrical portions and defining therewith a seat which can accommodate a roll of film.

13. Apparatus as claimed in claim 12, wherein said two semi-cylindrical portions each have a rib extending longitudinally therealong, said ribs engaging a terminal edge of the first half-shell of a respective one of said containers to prevent rotation of said adapter element relative to said respective one of the containers when the adapter element is enclosed in the half-shells.

14. Apparatus as claimed in claim 11, wherein said containers each include a layer of soft material coating inner surfaces of the half-shells thereof.

15. Apparatus as claimed in claim 14, wherein said door includes a seat at the underside thereof which faces said film insertion space when said door is in the position thereof covering said film insertion space, and a movable contact element mounted in said seat so as to be slidable over a short stroke relative thereto, said contact element resting on either a roll of film or one of said containers when the roll of film or the one of said containers is inserted in the magazine within said film insertion space and said door is in the position thereof at which the door covers said space.

16. The combination of a film developing machine and apparatus for preparing film for insertion thereof into the film developing machine.

said apparatus comprising a preparation station including a table having a plurality of seats; and a plurality of film containers capable of receiving films of different sizes, a plurality of film leaders, film splicing material capable of joining film to the leaders, film identification, and a magazine all received in the seats of said table;

said magazine including a flat plate-like member having an opening extending transversely therein which forms a film insertion space of dimensions corresponding to those of said film containers such said film containers are individually insertable into said magazine within said film insertion space, a second plate-like member integral with and extending perpendicular to said first plate-like member at a front end thereof, and a door hinged to said first plate-like member so as to be pivotable between respective positions at which said door covers and uncovers said film insertion space, said first plate-like member also having an opening extending longitudinally therein and of a width corresponding to that of said film leaders such that said film leaders can be individually inserted into said first plate-like member, said first plate-like member also having a through-hole extending therein and open to the longitudinally extending opening so that a leader fully inserted in said first plate-like member will be exposed at said through-hole, and said first plate-like member also having a plurality of additional through-holes extending therein and open to the longitudinally extending opening, said additional through-holes spaced from one another in the transverse direction of said first plate-like member; and said film developing machine including an outer casing which house chemical baths used to develop film, optoelectronic means disposed within said outer casing for detecting the size of film introduced into the film developing machine for development, and a loading station defining an opening in said outer casing through which film is introduced therein to the chemical baths, said loading station comprising an elongate box-like casing into which said magazine is insertable, a pair of coacting cylindrical driving rollers disposed within said box-like casing at such a position as to entrain a film leader located within said opening extending longitudinally in the magazine when the magazine is fully inserted into said box-like casing and the rollers are driven, first and second microswitches located on said box-like casing at positions at which the microswitches are actuatable by respective portions of said magazine including said first plate-like member thereof when said magazine is inserted into said box-like casing, at least one spring pushing element projecting in said box-like casing and exerting a biasing force acting in a direction extending toward the outside of the film developing machine such that the biasing force is exerted on the magazine when the magazine is inserted into the box-like casing of the loading station, a spring pin actuator movable into and out of said box-like casing so as to selectively engage the magazine when inserted into the box-like casing of the loading station to maintain the magazine within the box-like casing against the biasing force exerted by said at least one spring pushing element and release the magazine to allow said at least one spring pushing element to push the magazine in a direction out of the box-like casing of said loading station, and a film cutter actuable to cut a terminal end of film withdrawn from the magazine by the entrainment of the film by said cylindrical driving rollers, said microswitches being operatively connected to said optoelectronic means, said cylindrical driving rollers, said spring pin actuator and said cutter in a manner in which the operational states said optoelectronic means, said cylindrical driving rollers, said spring pin actuator and said cutter are controlled based on actuation states of said microswitches.

17. The combination of a film developing machine and film preparation apparatus as claimed in claim 16, wherein said film magazine has a recess therein, said spring pin actuator includes a pin, a spring biasing said pin towards the inside of said box-like casing, and an electromagnet operatively associated with said pin so as to withdraw said pin from the interior of said casing against the force of said spring when the electromagnet is energized.

18. The combination of a film developing machine and film preparation apparatus as claimed in claim 16, wherein said cutter includes a cutter casing disposed below said box-like casing, an electromagnet housed within said cutter casing, and a vertically slidable blade operatively associated with said electromagnet so as to be movable between a lowered position when the electromagnet is deenergized and a lifted cutting position when the electromagnet is energized.

* * * * *